US012758079B2

(12) United States Patent
Ahn et al.

(10) Patent No.: US 12,758,079 B2
(45) Date of Patent: Oct. 13, 2026

(54) DISHWASHER AND METHOD OF CONTROLLING DISHWASHER

(71) Applicant: SAMSUNG ELECTRONICS CO., LTD., Suwon-si (KR)

(72) Inventors: Joonho Ahn, Hwaseong-si (KR); Hyunchan Park, Hwaseong-si (KR); Hyungu Jeong, Gyeonggi-do (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 126 days.

(21) Appl. No.: 18/569,109

(22) PCT Filed: May 10, 2022

(86) PCT No.: PCT/KR2022/006610

§ 371 (c)(1),
(2) Date: Dec. 11, 2023

(87) PCT Pub. No.: WO2022/240113

PCT Pub. Date: Nov. 17, 2022

(65) Prior Publication Data

US 2025/0213094 A1 Jul. 3, 2025

(30) Foreign Application Priority Data

May 13, 2021 (KR) ..... 10-2021-0061939
Feb. 14, 2022 (KR) ..... 10-2022-0018817
Feb. 14, 2022 (KR) ..... 10-2022-0018825

(51) Int. Cl.
*A47L 15/00* (2006.01)
*A47L 15/42* (2006.01)

(52) U.S. Cl.
CPC ..... *A47L 15/0034* (2013.01); *A47L 15/4259* (2013.01); *A47L 2401/26* (2013.01)

(58) Field of Classification Search
CPC ..... A47L 15/0034; A47L 15/4259; A47L 2401/26; E05B 65/5215; E05B 65/00;
(Continued)

(56) References Cited

U.S. PATENT DOCUMENTS 5,209,530 A 5/1993 Kolloch
10,597,904 B2 3/2020 Hintz et al.
(Continued)

FOREIGN PATENT DOCUMENTS

CN 105220966 A 1/2016
CN 108078528 A 5/2018
(Continued)

OTHER PUBLICATIONS

Machine translation and numbered paragraphs of CN 108420382 (Year: 2018).*

(Continued)

*Primary Examiner* — Christine M Mills
*Assistant Examiner* — Christopher F Callahan
(74) *Attorney, Agent, or Firm* — STAAS & HALSEY LLP

(57) ABSTRACT

Disclosed herein are a dishwasher and a method of controlling the dishwasher. The dishwasher includes: a first sensor configured to detect whether a push bar for selectively opening and closing a door has deviated from a first reference point; a second sensor configured to detect changes in the signal attributable to the movement of the push bar based on a second reference point that is different from the first reference point; a third sensor configured to detect changes in the signal attributable to the movement of a movable member, to which the push bar can be coupled, based on a third reference point that is different from the second reference point; and a control unit configured to determine the
(Continued)

opened/closed state of the door based on the detection result of at least one of the first, second, and third sensors.

7 Claims, 25 Drawing Sheets

(58) Field of Classification Search
CPC ..... E05B 65/06; E05B 65/52; E05B 17/0025; E05B 17/0033; E05B 17/0037; E05B 15/0245; E05B 15/04; E05B 2015/105; E05B 2015/108; E05C 3/28; E05C 3/34; E05C 19/026
See application file for complete search history.

(56) References Cited

U.S. PATENT DOCUMENTS

| | | | | |
|---|---|---|---|---|
| 2005/0194795 | A1* | 9/2005 | Hapke | E05C 3/24 292/216 |
| 2006/0231122 | A1 | 10/2006 | Stelzer et al. | |
| 2006/0283482 | A1 | 12/2006 | Berends et al. | |
| 2011/0074261 | A1 | 3/2011 | Assmann et al. | |
| 2014/0077671 | A1* | 3/2014 | Dirnberger | A47L 15/4259 312/228 |
| 2014/0346938 | A1 | 11/2014 | Unverdi et al. | |
| 2015/0267446 | A1* | 9/2015 | Promutico, I | E05C 19/02 292/122 |
| 2015/0361690 | A1 | 12/2015 | Hintz et al. | |
| 2016/0029872 | A1* | 2/2016 | Kim | F16J 15/061 312/228 |
| 2017/0275927 | A1* | 9/2017 | Park | E05B 17/22 |
| 2019/0150701 | A1 | 5/2019 | Chirumbolo et al. | |
| 2020/0100643 | A1* | 4/2020 | Park | A47L 15/22 |

FOREIGN PATENT DOCUMENTS

| | | | | | |
|---|---|---|---|---|---|
| CN | 108420382 | A | * | 8/2018 | A47L 15/4259 |
| CN | 111802996 | A | | 10/2020 | |
| DE | 39 22 754 | A1 | | 1/1991 | |
| EP | 3 741 286 | A1 | | 11/2020 | |
| JP | 2020-58461 | | | 4/2020 | |
| KR | 10-2007-0053050 | A | | 5/2007 | |
| KR | 10-2010-0009887 | A | | 1/2010 | |
| KR | 10-2014-0023228 | A | | 2/2014 | |
| KR | 10-2016-0016248 | A | | 2/2016 | |
| KR | 10-1687648 | B1 | | 12/2016 | |
| KR | 20170082105 | A | * | 7/2017 | E05B 15/00 |
| KR | 10-2017-0137521 | A | | 12/2017 | |
| KR | 10-2017-0137523 | A | | 12/2017 | |
| KR | 10-2018-0003313 | A | | 1/2018 | |
| KR | 10-2021-0066413 | A | | 6/2021 | |

OTHER PUBLICATIONS

Notice of Patent Allowance issued Feb. 14, 2025 for Application No. 10-2022-0038578 (original application No. 10-2021-0061939).
Partial Supplementary European Search Report issued Apr. 14, 2025 for Application No. 22807761.6.
International Search Report for corresponding International Application No. PCT/KR2022/006610 mailed Aug. 17, 2022.
Written Opinion for corresponding International Application No. PCT/KR2022/006610 mailed Aug. 17, 2022 and English translation.
International Preliminary Report on Patentability for corresponding International Application No. PCT/KR2022/006610 dated Nov. 14, 2023.
Office Action dated Nov. 26, 2025 issued in European Application No. 22 807 761.6.
Extended European Search Report issued Jun. 9, 2026 for Application No. 26165261.4.

* cited by examiner

DISHWASHER AND METHOD OF CONTROLLING DISHWASHER

CROSS-REFERENCE TO RELATED APPLICATION

This application claims the benefit of Korean Patent Application No. 10-2021-0061939, No. 10-2022-0018817, and No. 10-2022-0018825 filed on the KIPO, which is hereby incorporated by reference herein in its entirety.

BACKGROUND

1. Technical Field

The present disclosure relates to a dishwasher and a method of controlling the dishwasher, and more particularly to a device and method for controlling the opening and closing of the door of a dishwasher and also controlling the process of drying and storing dishes in the dishwasher.

2. Description of the Related Art

A dishwasher is an apparatus that sprays washing water onto dishes, stored therein, at high pressure, cleans them, and then dries them. A dishwasher is operated such that washing water is sprayed into a wash tub, in which dishes are stored, at high pressure and the sprayed washing water reach the dishes and wash away foreign materials such as food residues on the surfaces of the dishes. A dishwasher performs various functions such as the washing, drying, and storing of dishes according to control commands for these operations and cycles corresponding to control processes.

In general, dishwashers are designed to stop operation with a door closed after washing or drying is completed. Accordingly, conventional dishwashers have a problem in that an odor is generated due to the moisture remaining inside a wash tub after the completion of a specific cycle.

In order to alleviate the above-described problem, there was conceived a method of adding a device for discharging the moisture generated after a specific cycle has been completed with a door closed and supplying air to dry dishes to a dishwasher. However, this method has a problem in that, when moisture is discharged and air is supplied to dry dishes, a pressure higher than that in the case where a door is opened needs to be generated because an outlet for discharging moisture is narrow, resulting in increased noise. Accordingly, there is a disadvantage in that the power consumption of the dishwasher increases in order to operate the additional device.

In addition, in order to alleviate the above-descried problem, there was conceived a method of automatically opening the door of a dishwasher to discharge generated moisture and enable air to circulate after the completion of a specific cycle. However, when the door is not controlled accurately, the method of automatically opening the door may cause problems in that dishes are re-contaminated because the door is not closed again after the discharging of moisture and there is a high possibility of accidents such as the accident in which a user's finger is caught in the door because the opened/closed state of the door cannot be determined accurately.

Therefore, in order to use a method of automatically opening a door after the completion of a specific cycle and to effectively dry and store dishes, there is a demand for a dishwasher control method and device that can accurately determine and control the opened/closed state of a door.

SUMMARY

The present disclosure has been conceived to overcome the problems of the above-described background art, and the present disclosure is intended to provide a device and method that can accurately determine and control the opened/closed state of the door of a dishwasher.

Furthermore, the present disclosure is intended to provide a control device and method that enable air to circulate smoothly during the process of drying and storing dishes in a dishwasher. Moreover, the present disclosure is intended to provide a door opening and closing device for a dishwasher that can implement automatic door opening and automatic door closing.

However, the objects accomplished by the present disclosure are not limited to the above-described objects, and other objects not described above can be clearly understood based on the following description.

According to an aspect of the present disclosure, there is provided a door opening and closing device for a dishwasher, the door opening and closing device being provided on one side of the main body of a dishwasher and performing the opening of a door with respect to the main body, the door opening and closing device including: a case fixed to the main body; a movable member disposed inside the case to be slidably movable in forward and rearward directions with respect to the case; a latch unit including a left latch rotatably mounted on a fixing shaft on the inner left side of the movable member and a right latch rotatably mounted on a fixing shaft on the inner right side of the movable member; and a latch guide member disposed on the movable member to be slidably movable over a predetermined distance in the forward and rearward directions with respect to the movable member; wherein the latch guide member guides the latch unit so that the left and right latches are rotated symmetrically with each other as the latch guide member slides.

According to another aspect of the present disclosure, there is provided a dishwasher including: a first sensor configured to detect whether a push bar for selectively opening and closing a door has deviated from a first reference point; a second sensor configured to detect changes in the signal attributable to the movement of the push bar based on a second reference point that is different from the first reference point; a third sensor configured to detect changes in the signal attributable to the movement of a movable member, to which the push bar can be coupled, based on a third reference point that is different from the second reference point; and a control unit configured to determine the opened/closed state of the door based on the detection result of at least one of the first, second, and third sensors.

According to still another aspect of the present disclosure, there is provided a control method for drying and managing dishes in a dishwasher, the control method including: evaporating moisture on dishes using heat generated during a washing cycle; discharging water vapor out of a dishwasher by partially opening the door of the dishwasher; drying the dishes by introducing purified hot air into the dishwasher; closing the partially opened door; and ventilating air inside the dishwasher at a predetermined period.

BRIEF DESCRIPTION OF THE DRAWINGS

The above and other objects, features, and advantages of the present disclosure will be more clearly understood from the following detailed description taken in conjunction with the accompanying drawings, in which.

DETAILED DESCRIPTION

Figure 1:
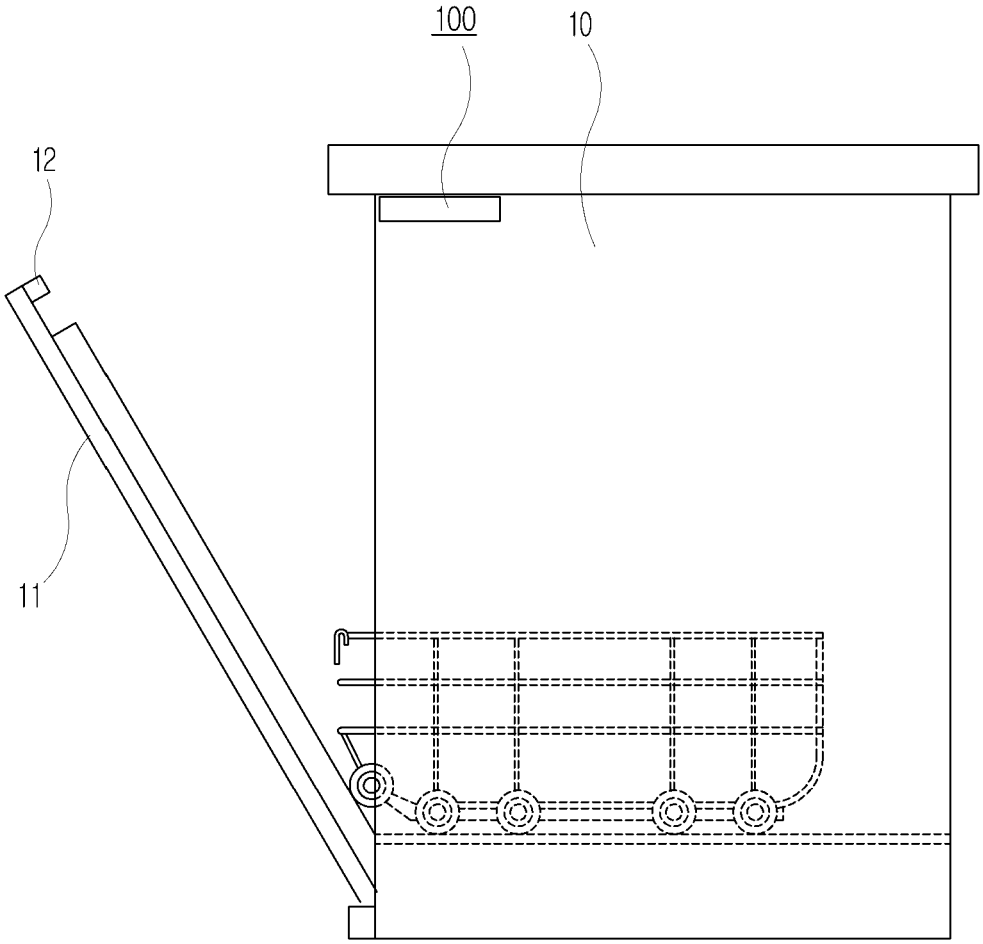
FIG. 1 is a conceptual diagram showing a section of a dishwasher in which equipped with a door opening and closing device according to an embodiment of the present disclosure.

Embodiments of the present disclosure will be described in detail below with reference to the accompanying drawings so that those having ordinary skill in the art to which the present disclosure pertains (hereinafter referred to as "those skilled in the art") can easily implement the present disclosure. The embodiments presented in the present disclosure are provided to enable those skilled in the art to use or practice the subject matter of the present disclosure. Accordingly, various modifications to the embodiments of the present disclosure will be apparent to those skilled in the art. In other words, the present disclosure may be implemented in various different forms and is not limited to the following embodiments.

The same or similar reference numerals refer to the same or similar elements throughout the specification of the present disclosure. Furthermore, in order to clearly describe the present disclosure, reference numerals in the drawings may be omitted for parts that are not related to the description of the present disclosure.

The term "or" used herein is intended to mean an inclusive "or," not an exclusive "or." That is, unless otherwise specified herein or unless the meaning is clear from the context, "X uses A or B" should be understood to mean one of natural implicit substitutions. For example, unless otherwise specified herein or unless the meaning is clear from the context, the case where "X uses A or B" can be interpreted as any one of the case where X uses A, the case where X uses B, and the case where X uses both A and B.

The term "and/or" used herein should be understood to refer to and include all possible combinations of listed related concepts.

The terms "include" and/or "including" used herein should be understood to mean that specific features and/or elements are present. However, the terms "include" and/or "including" should be understood as not excluding the presence or addition of one or more other features, other components, and/or combinations thereof.

Unless otherwise specified herein or the context clearly indicates a singular form, a singular form should be construed to include "one or more items."

The term "N-th (where N is a natural number)" used herein can be understood as an expression used to distinguish the components of: the present disclosure according to a predetermined standard such as a functional perspective, a structural perspective, or convenience of description. For example, in the present disclosure, components performing different functional roles may be distinguished as a first component and a second component. However, components that are substantially the same within the technical spirit of the present disclosure but should be distinguished for convenience of description may also be distinguished as a first component and a second component.

Meanwhile, the term "module" or "unit" used herein may be understood as a term referring to an independent functional unit that processes resources such as a computer-related entity, firmware, software or part thereof, hardware or part thereof, and a combination of software and hardware. In this case, the term "module" or "unit" may be a unit composed of a single element, or may be a unit expressed as a combination or set of multiple elements. For example, in a narrow sense, the term "module" or "unit" may refer to a hardware element or a set of hardware elements of a device, an application program performing a specific function of software, a procedure implemented through the execution of software, a set of instructions for the execution of a program, or the like. Furthermore, in a broad sense, the term "module" or "unit" may refer to a device itself constituting part of a system, or a program itself executed on a device. However, the above-described concepts are only examples, so that the concept of "module" or "unit" may be defined in various manners within a range in which they can be understood by those skilled in the art based on the description of the present disclosure.

The term "connection" used herein should be interpreted to include the case where components are "directly connected" to each other, the case where components are "electrically connected" to each other, and the case where components are connected to each other "with another component interposed therebetween."

The descriptions of the terms used herein are intended to help the understanding of the present disclosure. Accordingly, it should be noted that unless the terms used herein are explicitly described as limiting the content of the present disclosure, the terms should not be used in the sense of limiting the technical spirit of the present disclosure.

Figure 2A:
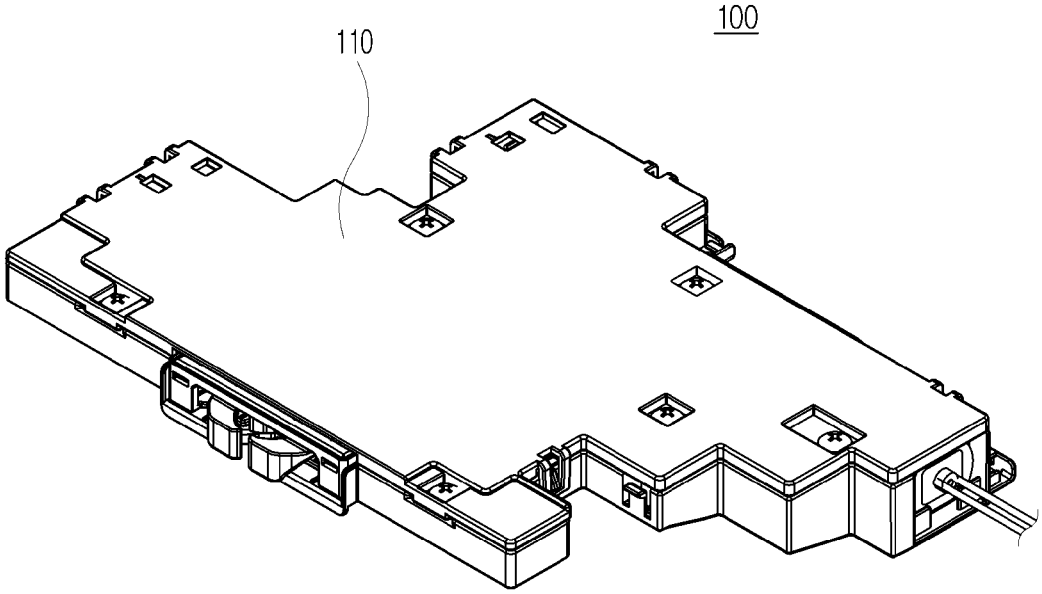
FIG. 2*a* is a perspective view of the door opening and closing device for a dishwasher according to the embodiment of the present disclosure.
Figure 2B:
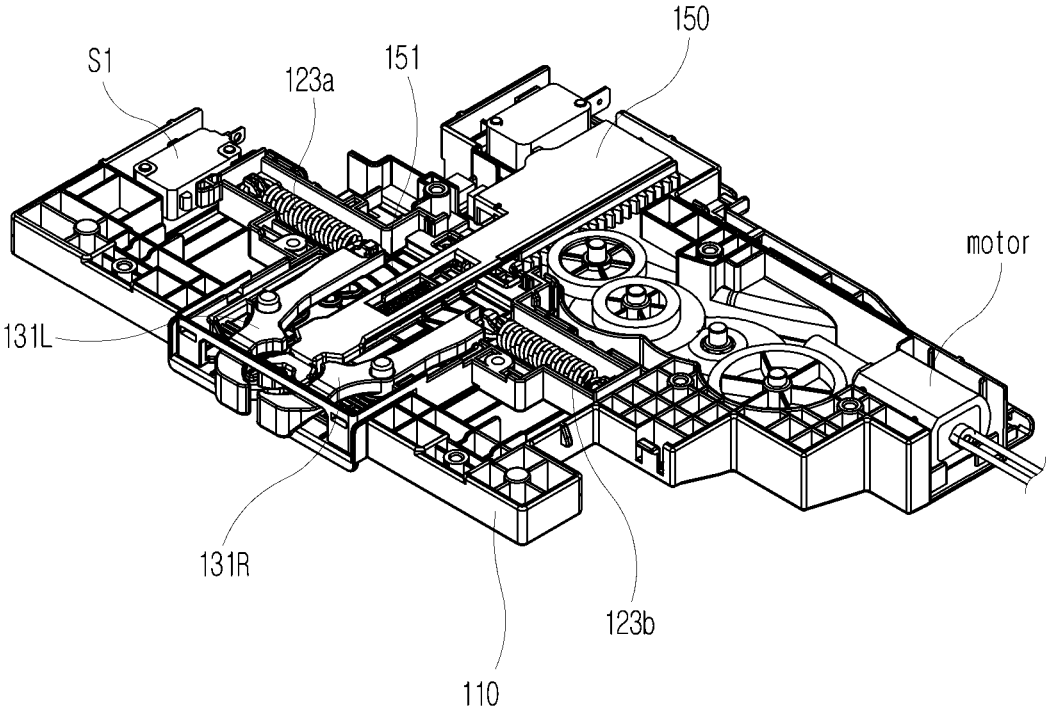
FIG. 2*b* is a see-through view of FIG. 2*a;*
Figure 2C:
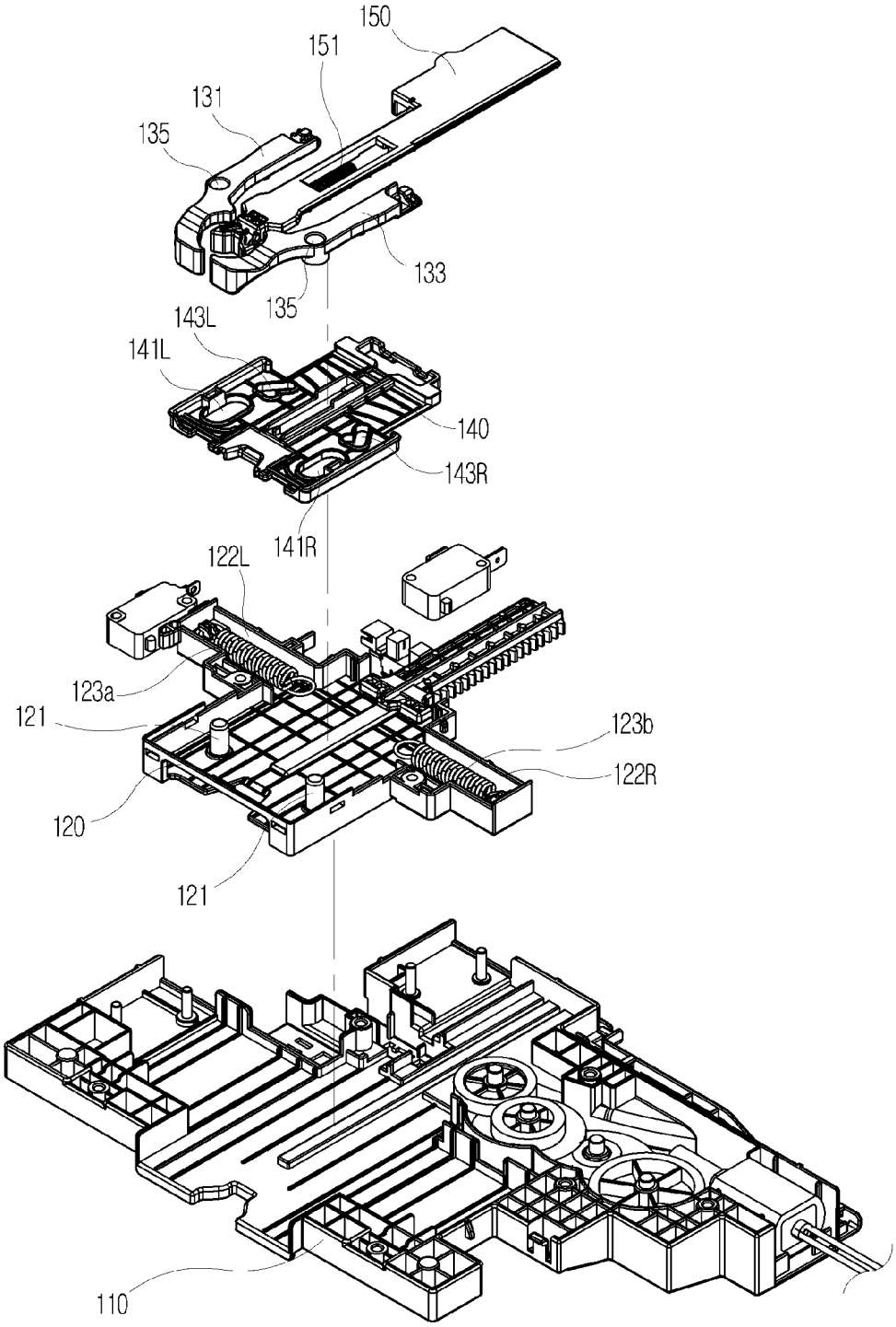
FIG. 2*c* is an exploded perspective view of FIG. 2*a;*
Figure 2D:
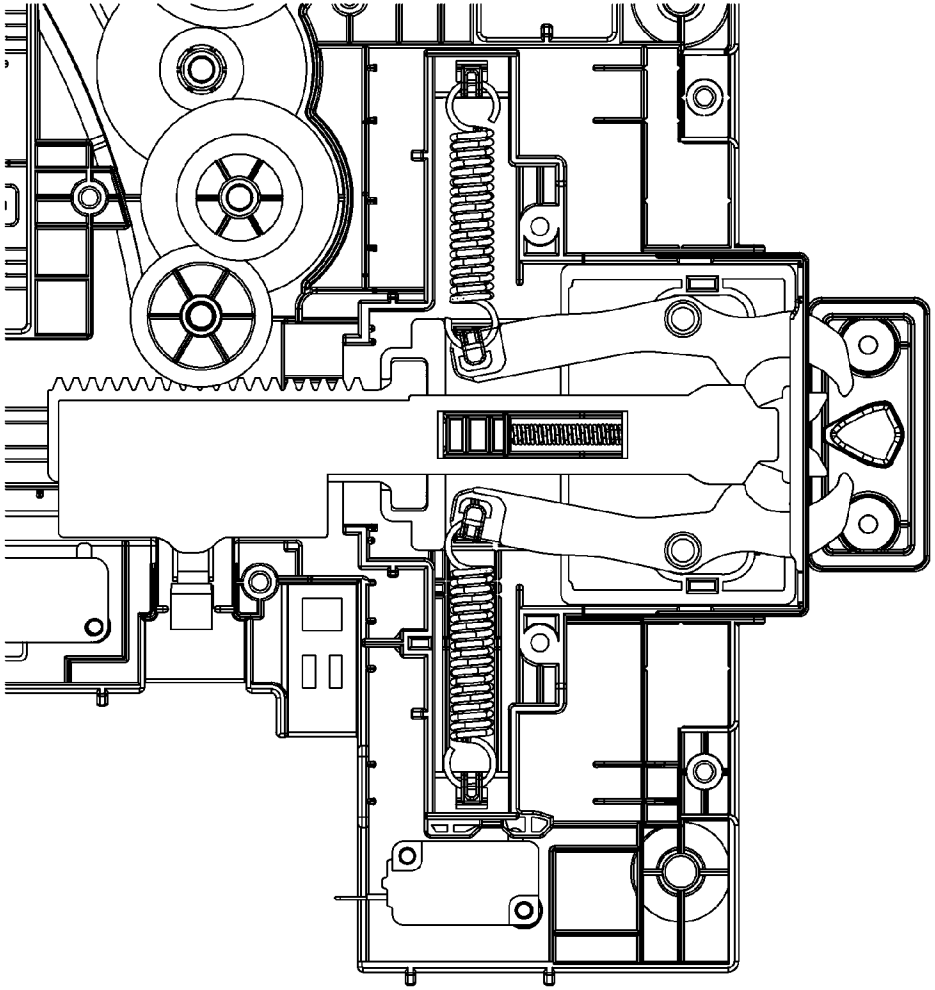
FIG. 2*d* is a partial enlarged view of the door opening and closing device of the present disclosure.
Figure 2E:
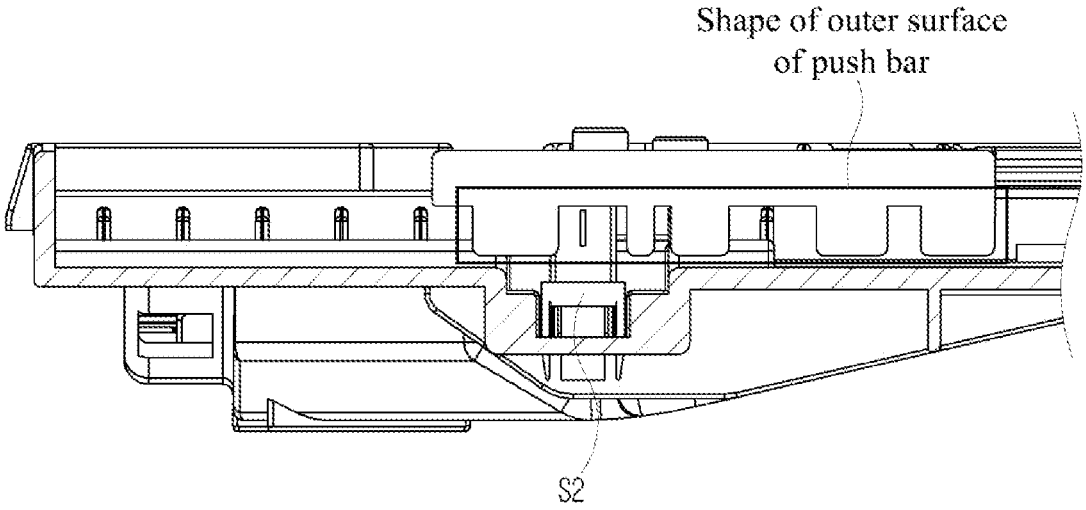
FIG. 2*e* is a partial side view of the door opening and closing device.
Figure 3:
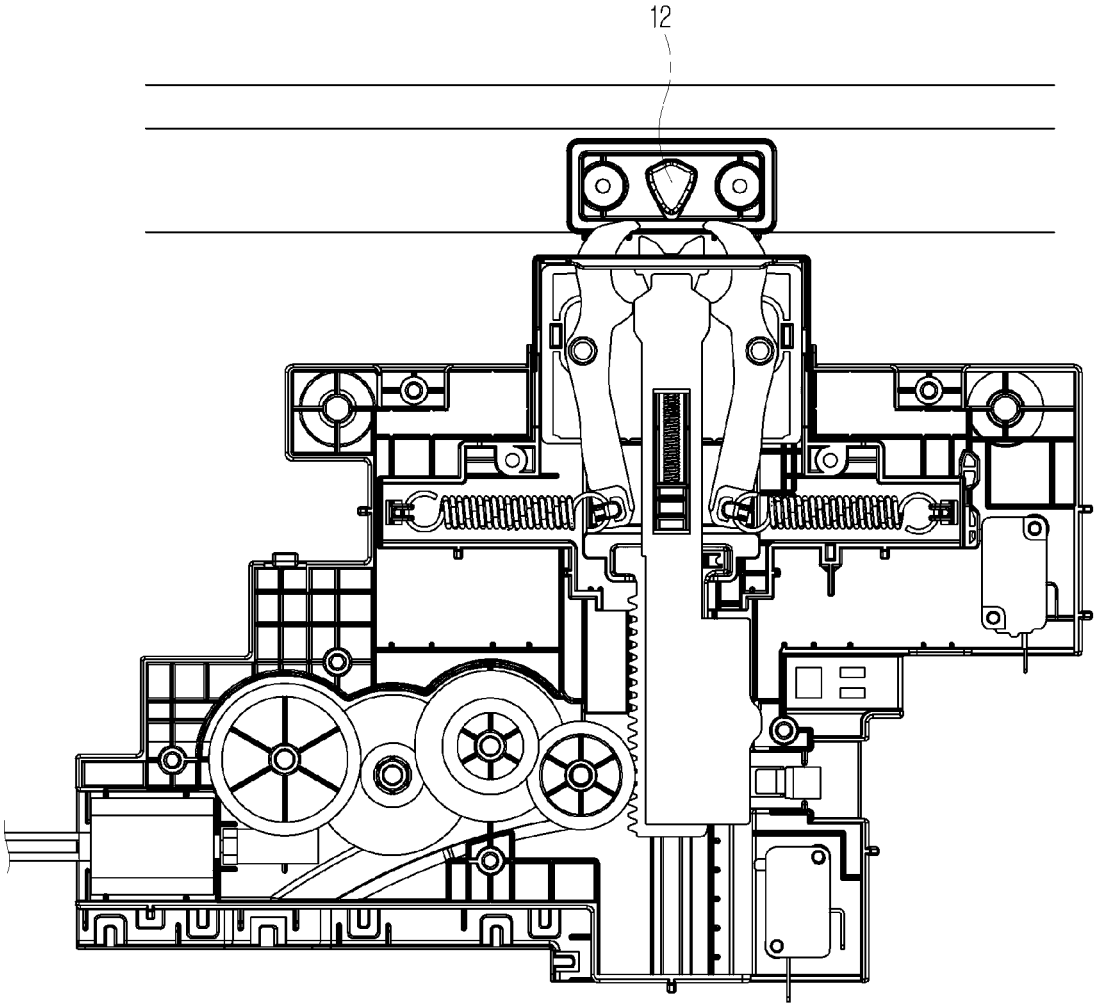
FIG. 3 is a conceptual diagram showing the door opening and closing device in the state in which the coupling boss of a door is released.
Figure 4A:
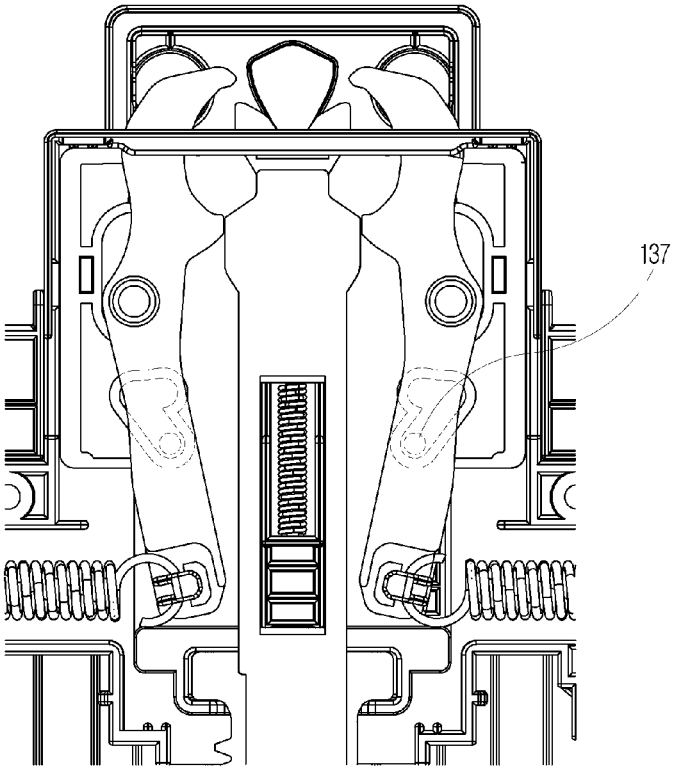
FIG. 4*a* is a conceptual diagram showing the door opening and closing device in the process in which the coupling boss of the door is restrained.
Figure 4B:
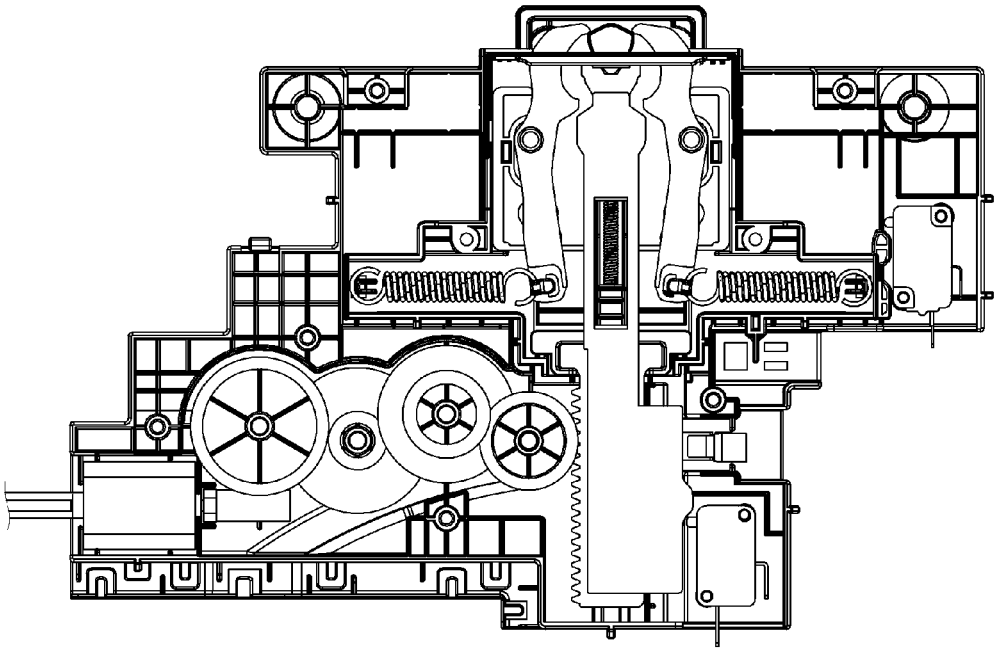
FIG. 4*b* is a conceptual diagram showing the door opening and closing device in the process in which the coupling boss of the door is restrained.
Figure 5:
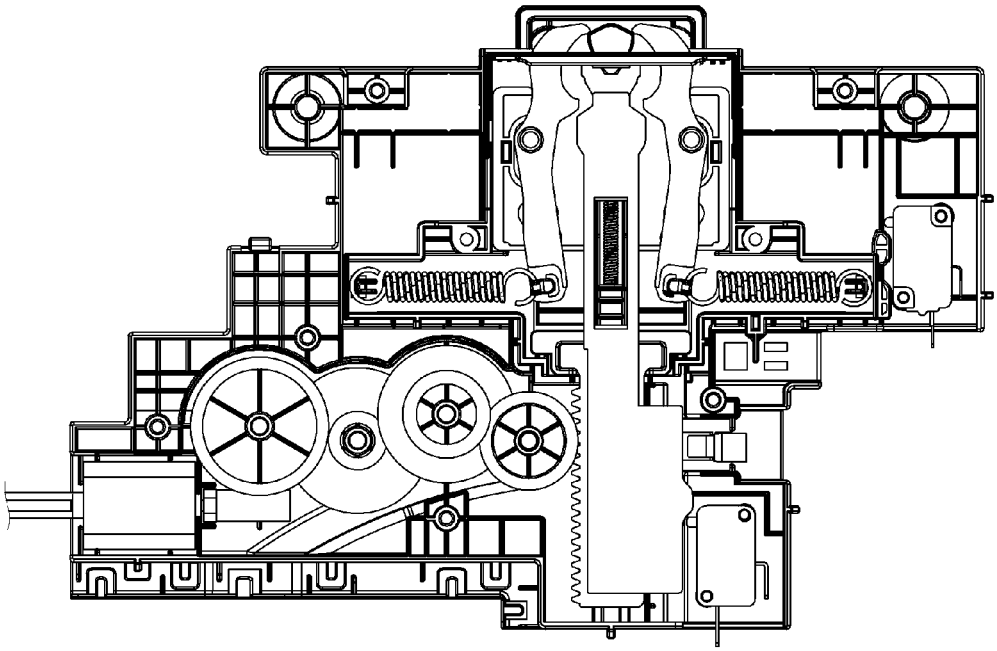
FIG. 5 is a conceptual diagram showing the door opening and closing device in the state in which the coupling boss of the door is restrained.
Figure 6:
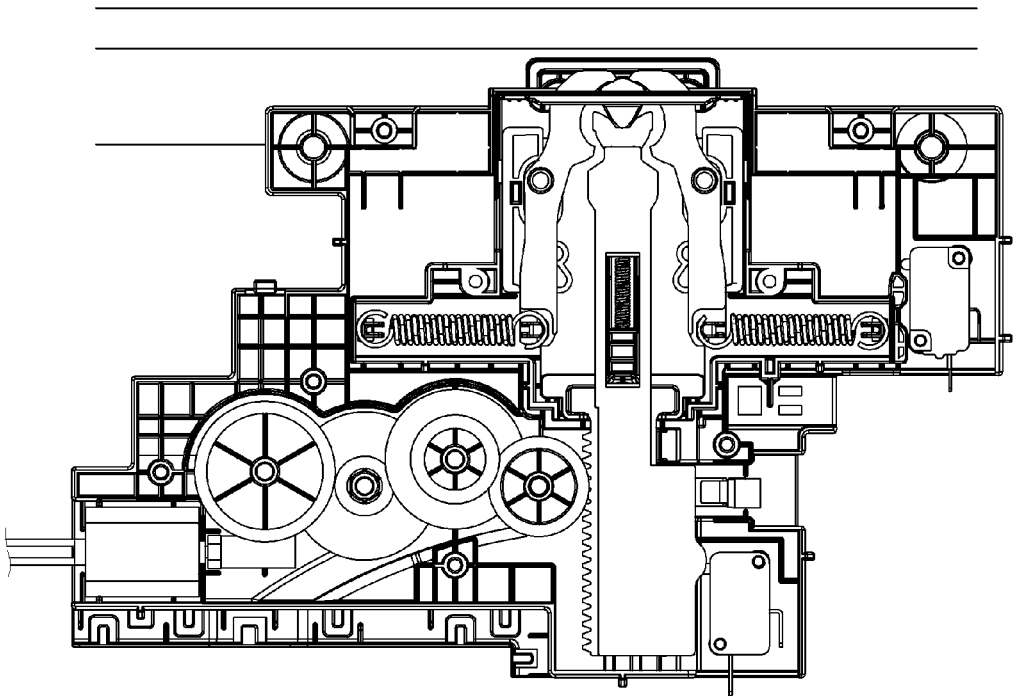
FIG. 6 is a conceptual diagram showing the internal structure of the door opening and closing device when the door is completely closed.

FIG. 1 is a conceptual diagram showing a section of a dishwasher equipped with a door opening and closing device according to an embodiment of the present disclosure, FIG. 2*a* is a perspective view of the door opening and closing device for a dishwasher according to the embodiment of the present disclosure, FIG. 2*b* is a see-through view of FIG. 2*a*, FIG. 2*c* is an exploded perspective view of FIG. 2*a*, FIG. 2*d* is a partial enlarged view of the door opening and closing device of the present disclosure, and FIG. 2*e* is a partial side view of the door opening and closing device. Furthermore, FIG. 3 is a conceptual diagram showing the door opening and closing device in the state in which the coupling boss of a door is released, FIG. 4*a* is a conceptual diagram showing the door opening and closing device in the process in which the coupling boss of the door is restrained, FIG. 4*b* is a conceptual diagram showing the door opening and closing device in the process in which the coupling boss of the door is restrained, FIG. 5 is a conceptual diagram showing the door opening and closing device in the state in which the coupling boss of the door is restrained, and FIG. 6 is a conceptual diagram showing the internal structure of the door opening and closing device when the door is completely closed.

As shown in FIG. 1, the door opening and closing device 100 for a dishwasher according to the present disclosure is provided on one side of the main body 10 of a dishwasher, more specifically at the upper end of the open side of the main body 10, and selectively opens and closes a door 11 with respect to the main body 10 by restraining or releasing a coupling boss 12, provided at the upper end of the door 11, with respect to the main body 10. This door opening and closing device 100 includes a case 110, a movable member 120, a latch unit, a latch guide member 140, and a push bar 150.

As shown in the drawings, the door opening and closing device 100 may be composed of one module in which component parts are assembled together inside the case 110, and the modular door opening and closing device 100 may be installed in a dishwasher by fixing the case 110 to a predetermined location on the main body 10.

The movable member 120 is provided inside the case 110. The movable member 120 is disposed to be slidable along the profile shape of the case 110 in the forward and rearward directions with respect to the case 110. As shown in FIG. 2*b*, one or more partitions are provided inside the case 110 so that the disposition location of the movable member 120 can be defined. More specifically, the movable member 120 is fixed in position by left and right partitions so that the movable member 120 is restricted from moving in the left and right directions, and the partitions are formed at intervals in the forward and rearward directions so that the movable member 120 can move in parallel in the forward and rearward directions in the space between the partitions. The movable member 120 is configured such that the front end of the movable member 120 is recessed inside the front end of the case 110 (see FIG. 2*b*) when the movable member 120 is disposed at the rearmost location in the forward and rearward directions inside the case 110 and the front end of the movable member 120 protrudes forward and outward from the front end of the case 110 as the movable member 120 slides forward.

Meanwhile, the movable member 120 is driven forward and rearward by a driving source (a motor). More obviously, the latch guide member 140 is moved forward and rearward by the motor, the forward movement force of the latch guide member 140 pulls the movable member 120 forward, and conversely, the rearward movement force of the latch guide member 140 pulls the movable member 120 rearward. Accordingly, the movable member 120 is moved forward and rearward. More specifically, as shown in FIG. 2*b*, a drive train is installed inside the case 110, and the drive train includes the motor and at least one gear. Meanwhile, a rack gear is installed at the rear end of the latch guide member 140 that slides within the movable member 120. The driving force generated by the rotation of the motor rotates the at least one gear, and the rotational force of the gear is transmitted to the rack gear formed on one side of the latch guide member 140 (e.g., the rear end of the latch guide member 140). As the rack gear moves straight forward, the latch guide member 140 connected to the rack gear moves forward, and the forward moving force of the latch guide member 140 pulls the movable member 120 forward. Conversely, as the rack gear moves straight rearward, the latch guide member 140 connected to the rack gear moves rearward, and the rearward moving force of the latch guide member 140 pulls the movable member 120 rearward.

In this case, the movable member 120 is movable forward and rearward in the limited space inside the case 110, and a stopper is installed within the case 110 and limits the forward and rearward movement of the movable member 120. First, when the motor is driven in the state in which the latch guide member 140 is disposed at the rear of the movable member 120, the latch guide member 140 is moved forward within the movable member 120 as the rack gear is moved forward by the rotation of the gear, and the movable member 120 is moved forward after the frontmost location has been reached. Thereafter, the forward movement of the movable member 120 is retrained by the stopper. Conversely, when the motor is driven in the state in which the latch guide member 140 is disposed at the front of the movable member 120, the latch guide member 140 is moved to the rear of the movable member 120 as the rack gear is moved rearward by the opposite rotation of the gear, and the movable member 120 is moved rearward after the rearmost location has been reached. Another stopper may be installed in the case 110 to limit the rearward movement of the movable member 120, and the rearward movement of the movable member 120 is restrained by this stopper.

Meanwhile, the present disclosure may further include a location sensor S1 for the movable member 120 configured to determine the location state of the movable member 120. For example, as shown in FIG. 2*b*, the location sensor S1 may be disposed on the outer side of the left arm portion 122L of the movable member 120. For the location sensor, for example, there may be adopted a method of modifying the shape of the outer surface of the left arm portion 122L, as shown in FIG. 2*e*, and then detecting the amount of movement of the movable member 120 by detecting changes in the signal received by the sensor as the movable member 120 moves in the forward and rearward directions.

Meanwhile, the latch unit includes a left latch 131 and a right latch 133. The movable member 120 has fixing shafts 121 formed on the inner left and right sides, respectively, based on the left and right center lines. The left latch 131 is rotatably mounted on the left fixing shaft 121, and the right latch 133 is rotatably mounted on the right fixing shaft 121. More specifically, the left and right latches 131 and 133 have respective fastening holes 135 at points between the front and rear ends thereof. In this case, the fastening holes 135 may be formed through the left and right latches 131 and 133, respectively. The left latch 131 is fitted around the left fixing shaft 121 through the fastening hole 135, and the right latch 133 is fitted around the right fixing shaft 121 through the fastening hole 135. The fixing shafts 121 are loosely fitted into the fastening holes 135, so that the left and right latches 131 and 133 are rotatably fixed onto the movable member 120 around the respective fixing shafts 121. Accordingly, these latches are integrated with the movable member 120 and slide forward and rearward together with the movable member 120 with respect to the movable member 120.

Meanwhile, the left and right latches 131 and 133 are coupled to the movable member 120 at their rear ends. More specifically, as shown in the drawings, the left arm portion 122L and a right arm portion 122R are formed on the left and right sides of the movable member 120, respectively, and a first elastic element 123*a* is disposed in the left arm portion 122L and a second elastic element 123*b* is disposed in the right arm portion 122R. The rear end of the left latch 131 is coupled to the first elastic element 123*a* disposed in the left arm portion 122L, and the rear end of the right latch 133 is coupled to the second elastic element 123*b* disposed in the right arm portion 122R. The first elastic element 123*a* and the second elastic element 123*b* may each be composed of a spring. The first elastic element 123*a* pulls the rear end of the left latch 131 to the left by an elastic restoring force, and similarly, the second elastic element 123*b* pulls the rear end of the right latch 133 to the right by an elastic restoring force. The left and right latches are rotated around the respective fastening holes 135 coupled around the fixing shafts 121. The front ends of the latches are located opposite the rear ends of the latches based on the fastening holes 135. As the first and second elastic elements pull the rear ends of the left and right latches by means of their own restoring force, the rear ends of the left and right latches attempt to remain distant from each other, and naturally the front ends of the left and right latches attempt to remain close to each other, i.e., in a close arrangement in which only a predetermined gap is present between them. Furthermore, the gap between the two ends of the latches is smaller than the size of the coupling boss 12 of the door 11.

Meanwhile, the latch guide member 140 is a component that guides the latch unit so that the left and right latches 131 and 133 are rotated symmetrically to each other. The latch guide member 140 is disposed on the movable member 120 and is configured to slide along the profile shape of the movable member 120 by a predetermined distance in the forward and rearward directions with respect to the movable member 120. As shown in FIG. 4*a*, the latch guide member 140 is fixed in position by the left and right walls of the movable member 120, so that movement is restrained in the left and right directions and parallel movement is allowed only in the forward and rearward directions. Alternatively, one or more partitions are provided on the left and right sides of the latch guide member 140 inside the movable member 120, and thus it may be possible to limit the range of movement of the latch guide member 140. More specifically, a method by which the latch guide member 140 is coupled to the movable member 120 is now described. When the latch guide member 140 is disposed on the movable member 120, a left fixing shaft receiving depression 141L and a right fixing shaft receiving depression 141R are provided at locations corresponding to the left and right fixing shafts 121 and 121 of the movable member 120, respectively. Furthermore, the left fixing shaft 121 and the right fixed shaft 121 are inserted into the left and right fixing shaft receiving depressions 141L and 141R, respectively, so that the latch guide member 140 is coupled to the movable member 120. In this case, these fixing shaft receiving depressions 141R and 141L extend long in the forward and rearward directions. Accordingly, the locations of the fixing shafts 121 within the elongated fixing shaft receiving depressions may vary, and thus the latch guide member 140 may move forward and rearward on the movable member 120 by the length of the fixing shaft receiving depressions. That is, the latch guide member 140 may slide forward and rearward with respect to the movable member 120 between the frontmost location at which the left and right fixing shafts 121 of the movable member 120 come into contact with the rear ends of the left and right fixing shaft receiving depressions, respectively, and the rearmost location at which the left and right fixing shafts 121 of the movable member 120 come into contact with the front ends of the left and right fixing shaft receiving depressions, respectively.

Meanwhile, as described above, the latch guide member 140 is a component that guides the latch unit so that the left and right latches 131 and 133 are rotated symmetrically to each other. To this end, the left and right latches 131 and 133 and the latch guide member 140 form a coupling relationship with each other. The coupling relationship is now described in detail. The latch guide member 140 has a left latch guide depression 143L and a right latch guide depression 143R behind the fixing shaft receiving depressions, respectively.

Furthermore, when the latch unit is disposed on the movable member 120, a coupling protrusion 137 formed behind the fastening hole 135 of the left latch 131 is inserted into the left latch guide depression 143L, and a coupling protrusion 137 formed behind the fastening hole 135 of the right latch 133 is inserted into the right latch guide depression 143R. In this case, the left latch guide depression 143L and the right latch guide depression 143R are characterized in that they are formed to extend long in inclined directions with respect to the forward and rearward directions. That is, the left latch guide depression 143L and the right latch guide depression 143R are characterized in that they are inclined to become closer to the inside of the latch guide member 140 in the directions from the front ends to the rear ends thereof. These latch guide depressions are each provided to have an inclination along the forward and rearward directions, and thus the coupling protrusions inserted into the latch guide depressions are moved along the orientations of the guide depressions. As a result, the left and right latches 131 and 133 are rotated around the fastening holes 135 fitted around the fixing shafts 121, respectively.

First, when the latch guide member 140 is located at the rear of the movable member 120 (see FIG. 4*b*), the coupling protrusions 137 of the left and right latches are present at the front ends of the left and right latch guide depressions 143L and 143R, respectively. The front ends of the left and right latch guide depressions 143L and 143R are located far outside to the left and right from the centers of the left and right sides of the latch guide member 140. In this state, the rear ends of the left and right latches are maximally spaced apart from each other. That is, in the process in which the latch guide member 140 moves rearward, as the coupling protrusions 137 of the left and right latches are guided by the left and right latch guide depressions 143L and 143R and moved toward the left and right sides of the latch guide member 140, respectively, the rear ends of the left and right latches are rotated in the directions in which the rear ends thereof move away from each other and the front ends thereof approach each other. In this case, as shown in FIG. 4*b*, the gap between the two front ends of the left and right latches becomes narrower than the size of the coupling boss 12 of the door 11, so that this is the location at which the coupling boss 12 of the door 11 is restrained.

Thereafter, when the latch guide member 140 moves forward on the movable member 120, the coupling protrusions 137 of the left and right latches are guided by the left and right latch guide depressions 143L and 143R and moved to the center of the latch guide member 140, and thus the left and right latches are rotated in the directions in which the rear ends thereof approach each other and the front ends thereof move away from each other. When the latch guide member 140 is located at the front of the movable member 120 (see FIG. 4*a*), the coupling protrusions 137 of the left and right latches are present at the rear ends of the left and right latch guide depressions 143L and 143R, respectively. The rear ends of the left and right latch guide depressions 143L and 143R are located closest to the centers of the left and right sides of the latch guide member 140. In this state, the rear ends of the left and right latches are maximally close to each other, and the front ends of the left and right latches are maximally spaced from each other. In this case, as shown in FIG. 4*a*, the gap between the two front ends of the left and right latches is opened wider than the size of the coupling boss 12 of the door 11, so that this is the location at which the coupling boss 12 of the door 11 is released.

Meanwhile, the push bar 150 is disposed on the latch guide member 140 and is configured to slide and move together with the latch guide member 140 in the forward and rearward directions with respect to the movable member 120. As will be described later, when the door 11 is closed, the push bar 150 allows the coupling boss 12 of the door 11 to enter the inside of the front end of the latch unit through the gap of the latch unit of the door opening and closing device 100. In this case, the push bar 150 serves to come into contact with the coupling boss 12 and stably guide it inward. Conversely, when the door 11 is opened, the coupling boss 12 of the door 11 is moved out of the front end of the latch unit through the gap of the latch unit of the door opening and closing device 100. In this case, the push bar 150 serves to elastically push the coupling boss 12 out of the door opening and closing device 100.

More specifically, the push bar 150 is disposed to be slidable along the profile shape of the latch guide member 140 in the forward and rearward directions with respect to the latch guide member 140. It is desirable to install a rail member along the center between the left and right sides of the latch guide member 140 so that the push bar 150 is disposed between the left and right latches 131 and 133. In this case, as shown in FIGS. 2*b* and 2*c*, the push bar 150 and the latch guide member 140 are coupled through a spring member 151. As the spring member 151 presses the push bar 150 forward at the rear end of the push bar 150, a repulsive force directed forward is applied when the push bar 150 moves rearward. Through this, when the door 11 is closed and the coupling boss 12 presses the front end of the push bar 150, the spring member 151 is contracted, so that the impact between the coupling boss 12 and the front end of the push bar 150 can be alleviated. Conversely, when the latch unit is opened and the coupling boss 12 is moved out of the front end of the latch unit, the spring member 151 is expanded, so that the coupling boss 12 can be elastically pushed out of the door opening and closing device 100. In this case, the present disclosure may further include a push bar sensor S2 configured to detect a change in the location of the push bar 150 and the amount of movement of the push bar 150. A photo sensor may be typically used as the push bar sensor S2. For example, there may be adopted a method of modifying the shape of the lower surface of the push bar as shown in FIG. 2*e*, applying a light emission signal from a side opposite to the push bar 150, and detecting the forward or rearward movement state and amount of movement of the push bar 150 via the detection pattern of a light reception signal through whether the light emission signal from the side opposite to the push bar 150 is received by the push bar sensor S2 as the push bar 150 moves in the forward and rearward directions.

Figure 7:
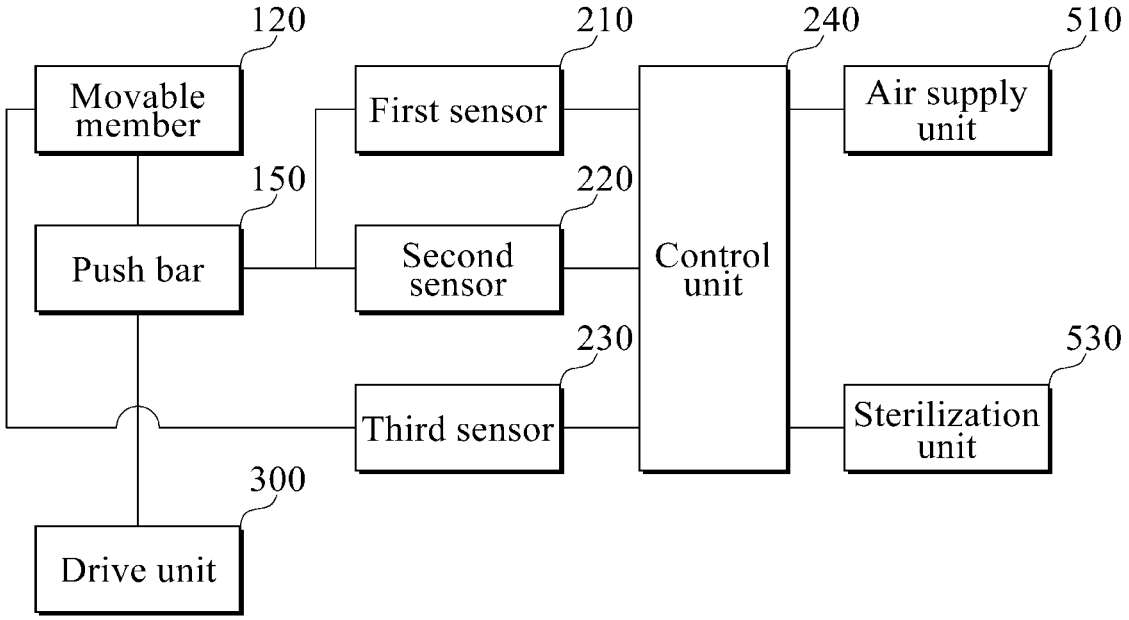
FIG. 7 is a block diagram showing a configuration of a dishwasher according to an embodiment of the present disclosure.

FIG. 7 is a block diagram showing a configuration of a dishwasher according to an embodiment of the present disclosure.

Referring to FIG. 7, the dishwasher according to the present embodiment may include a door 11, a push bar 150 configured to move in the opening and closing directions of the door 11, a movable member 120 configured to be coupled to the push bar 150, and a drive unit 300 configured to provide power for the movement of the push bar 150. The push bar 150 may be coupled to the movable member 120 and perform the operation of stably opening and closing the door 11 based on the power provided by the drive unit 300. When the door 11 is closed, the push bar 150 moves rearward based on the door 11 while in contact with the coupling boss of the door 11, so that the coupling boss can be guided into the dishwasher. When the door 11 is opened, the push bar 150 moves forward with respect to the door 11, so that the coupling boss of the door 11 can be elastically pushed outward. The movable member 120 may be combined with components requiring movement to selectively open and close the door 11, other than the push bar 150.

Furthermore, the dishwasher according to the present embodiment may include a device 100 for controlling the opening and closing of the door 11. The device 100 may include a first sensor 210 configured to detect whether the push bar 150 has deviated from a first reference point. The device 100 may include a second sensor 220 configured to detect changes in the signal attributable to the movement of the push bar 150 based on a second reference point that is different from the first reference point. The device 100 may include a third sensor 230 configured to detect changes in the signal attributable to the movement of the movable member 120, to which the push bar 150 can be coupled, based on a third reference point that is different from the second reference point. Furthermore, the device 100 may include a control unit 240 configured to determine the opened/closed state of the door 11 based on the detection result of at least one of the first sensor 210, the second sensor 220, and the third sensor 230. However, FIG. 7 is only an example, and thus only some of the components disclosed above may be included in the device 100 of the present disclosure.

Referring to FIG. 7, the first sensor 210 according to an embodiment of the present disclosure may detect whether the push bar 150 has deviated from the first reference point to open or close the door 11 by detecting changes in the signal based on the first reference point. The first sensor 210 may be disposed at the first reference point, and may screen the posterolateral area of the push bar 150 to check the opened/closed state of the door 11 and the operating state of the push bar 150. For example, the first sensor 210 may include a switch configured to detect whether the push bar 150 is in contact with the first reference point. The first reference point is the point at which the push bar 150 is located when the door 11 is closed, and may be a fixed point corresponding to the posterolateral area of the push bar 150. When the door 11 is closed and the push bar 150 is in a stable state in which it does not move, the push bar 150 may be in contact with the first reference point. In this case, the first sensor 210 may detect a state in which the push bar 150 is in contact with the first reference point. When the push bar 150 is in operation, as in the case where the door 11 is opened or a push signal is input, the push bar 150 may not be in contact with the first reference point. In this case, the first sensor 210 may detect a state in which the push bar 150 is not in contact with the first reference point. The type and detection operation of the first sensor 210 described above are only examples, and thus all sensors capable of detecting whether the push bar 150 has deviated from the first reference point are included in the first sensor 210.

The second sensor 220 according to an embodiment of the present disclosure may detect the operating state of the push bar 150 to open or close the door 11 by detecting changes in the signal generated based on the second reference point that is different from the first reference point. The second sensor 220 may be disposed at the second reference point, and may screen the lateral area of the push bar 150 to check the opened/closed state of the door 11 and the operating state of the push bar 150. For example, the second sensor 220 may include a switch configured to detect whether an optical signal is blocked in response to the movement of the push bar 150 based on the second reference point. The second reference point may be a fixed point corresponding to the lateral area of the push bar 150. As the push bar 150 moves to open or close the door 11, an optical signal may be input to the second reference point or blocked. The input or blocking of an optical signal in response to the operation of the push bar 150 may be performed by the sidewall structure of the push bar 150, which will be described in detail later with reference to FIG. 9. The second sensor 220 may detect the input or blocking of an optical signal for the second reference point and detect a change in the optical signal attributable to the input or blocking. The type and detection operation of the second sensor 220 described above are only examples, and thus all sensors capable of detecting changes in the signal for the second reference point, such as a contact switch, may be included in the second sensor 220.

The third sensor 230 according to an embodiment of the present disclosure may detect the operating state of the push bar 150 to open or close the door 11 by detecting changes in the signal generated based on the second reference point that is different from the first and second reference points. The third sensor 230 may be disposed at the third reference point, and may screen the lateral area of the movable member 120 to verify the opened/closed state of the door 11 and the operating state of the push bar 150. That is, unlike the first and second sensors 210 and 220, the third sensor 230 may detect changes in the signal for the third reference point based on the movement of the movable member 120 that moves together with the push bar 150 as the push bar 150 moves. This implies that the detection result of the third sensor 230 may be used auxiliary to double-check the detection results of the first and second sensors 210 and 220. For example, the third sensor 230 may include a switch configured to detect changes in the contact signal attributable to the movement of the movable member 120 based on the third reference point. The third reference point may be a fixed point corresponding to the lateral area of the movable member 120 to which the push bar 150 is coupled. As the push bar 150 moves to open or close the door 11, the movable member 120 coupled with the push bar 150 may also move in the same direction. When the door 11 is closed and the push bar 150 and the movable member 120 are in a stable state in which they do not move, the movable member 120 may be in contact with the third reference point. In this case, the third sensor 230 may detect a state in which the movable member 120 is in contact with the third reference point. When the push bar 150 and the movable member 120 are in operation, as in the case where the door 11 is opened or a push signal is input, the movable member 120 may be in a state switching between a state of being in contact with the third reference point and a state of not being in contact with the third reference point. In this case, the third sensor 230 may detect a change in the state in which the movable member 120 is in contact with the third reference point. The type and detection operation of the third sensor 230 described above are only examples, and thus all sensors capable of detecting changes in the signal for the third reference point may be included in the third sensor 230.

The control unit 240 according to an embodiment of the present disclosure may determine the opened/closed state of the door 11 based on the detection results of the first and second sensors 210 and 220. Furthermore, the control unit 240 may verify the determination attributable to the detection results of the first and second sensors 210 and 220 based on the detection result of the third sensor 230. That is, the control unit 240 may preferentially determine the opened/closed state of the door 11 based on the detection results of the first and second sensors 210 and 220, and may verify whether the previous determination is accurate based on the detection result of the third sensor 230. In order to accurately control the door 11 in accordance with the opened/closed state of the door 11 such as the closing of the door 11, the opening of the door 11, the partial opening of the door 11, or the forced opening of the door 11, it is important to accurately determine the opened/closed state of the door 11. Accordingly, in order to minimize errors that may occur in the process of determining the opened/closed state of the door 11, the control unit 240 may utilize the first and second sensors 210 and 220 to perform the primary determination of the opened/closed state of the door 11 and utilize the third sensor 230 as an auxiliary verification means. Alternatively, in some cases, the control unit 240 may utilize the second sensor 220 to perform the main determination of the opened/closed state of the door 11 and utilize the first and second sensors 210 and 220 as verification means.

Furthermore, the control unit 240 according to an embodiment of the present disclosure may determine and verify the opened/closed state of the door 11 based on the detection results of the sensors 210, 220, and 230, and may control the movement of the door 11 by operating the drive unit 300. For example, when the door 11 needs to be switched from the closed state to the opened state in response to an external input signal applied by a user, the control unit 240 operates the drive unit 300 to move the push bar 210 and the movable member 220 forward with respect to the door 11. In this case, the control unit 240 may check the opened/closed state of the door 11 in real time based on the results detected through the sensors 210, 220, and 230, and may control the drive unit 300 so that the door 11 is accurately opened. That is, the control unit 240 may control the movement of the door 11 through the drive unit 300 while performing determination and verification based on the detection results of the sensors 210, 220, and 230.

Meanwhile, the control unit 240 may be understood as a constituent unit including hardware and/or software for performing computing operations. For example, the control unit 240 may read a computer program, analyze the detection results of the sensors 210, 220, and 230, determine the opened/closed state of the door 11, and perform data processing for the control of the opening/closing of the door 11. The control unit 240 for performing such data processing may include a central processing unit (CPU), a general purpose graphics processing unit (GPGPU), a tensor processing unit (TPU), an application specific integrated circuit (ASIC), and a field programmable gate array (FPGA). The types of control unit 240 described above are only examples, and thus the types of control unit 240 may be configured in various forms within the range in which they can be understood by those skilled in the art based on the description of the present disclosure.

Figure 8:
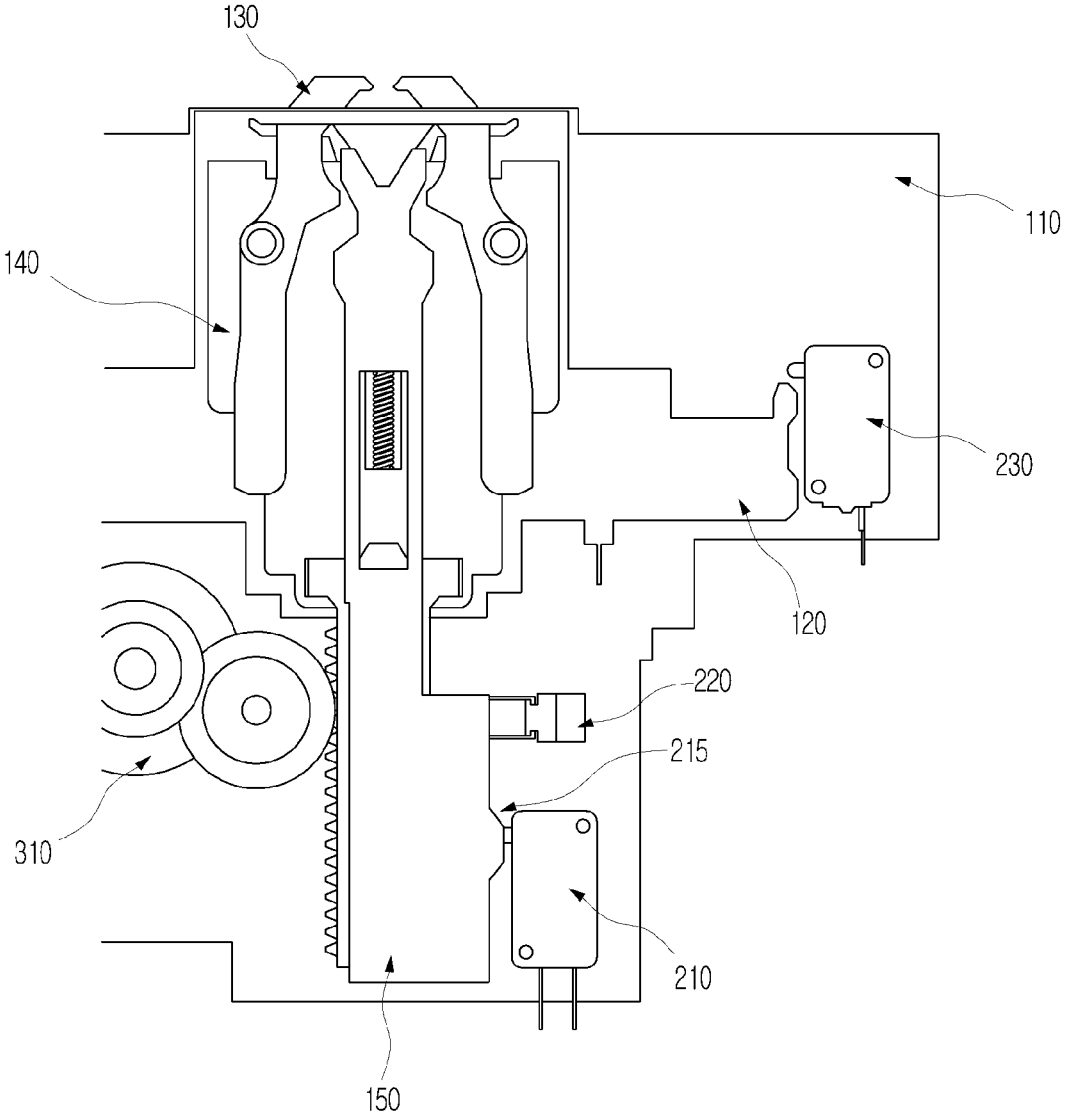
FIG. 8 is a plan view schematically illustrating components for controlling the opening and closing of the door of a dishwasher according to an embodiment of the present disclosure.

FIG. 8 is a plan view schematically illustrating components for controlling the opening and closing of the door of a dishwasher according to an embodiment of the present disclosure.

Referring to FIG. 8, the dishwasher according to the present embodiment includes sensors 210, 220 and 230 configured to detect the opened/closed state of the door 11, a push bar 150, a movable member 120, a latch unit 130, a latch guide member 140, a drive unit 300, and a case 110. However, FIG. 8 is only an example, and thus only some of the components disclosed above may be included in the device 100 of the present disclosure.

The push bar 150 according to an embodiment of the present disclosure may be disposed to be movable along a profile shape present on the latch guide member 140 in the forward and rearward directions with respect to the latch guide member 140. The push bar 150 may be disposed between the left and right latches of the latch unit 130 along a rail provided along the center between the left and right sides of the latch guide member 140. The push bar 150 and the latch guide member 140 may be coupled through an elastic member such as a spring. The push bar 150 may alleviate the impact that may occur during the process of opening and closing the door 11 through the elastic member, and may assist in stably opening and closing the door 11.

Furthermore, the push bar 150 may include a protrusion 215 configured to assist detection performed by the first sensor 210. The protrusion 215 may be formed on the side wall of the push bar 150 in order to come into contact with the first sensor 210 disposed at the first reference point corresponding to a posterolateral area of the push bar 150. The first sensor 210 may come into contact with the push bar 150 through the protrusion 215 and desirably detect whether the push bar 150 has deviated from the first reference point.

The movable member 120 according to an embodiment of the present disclosure may be disposed inside the case 110 so as to be movable in the forward and rearward directions with respect to the case 110, along the profile shape existing on the case 110. The movable member 120 may be directly coupled to the latch unit 130 and the latch guide member 240 through a fixing shaft. The movable member 120 may be indirectly coupled to the push bar 150 through a latch guide member 240 that is directly coupled to the push bar 150 through an elastic member. The movable member 120 may be pulled by the movement of the push bar 150 and the latch guide member 240, and may move together in accordance with the direction of movement of the push bar 150 and the latch guide member 240.

The latch unit 130 according to an embodiment of the present disclosure may be coupled to the movable member 120 and the latch guide member 240 through the fixing shaft of the movable member 120. In this case, the latch unit 130 may be disposed to be rotatable around the fixing shaft. Although not shown in FIG. 8, in order to enable the coupling boss of the door 11 to be stably controlled, the rear end of the latch unit 130 may be coupled to the movable member 120 through an elastic member such as a spring. The left and right latches of the latch unit 130 are rotated around the fixing shaft by using the elasticity of the elastic member, so that the coupling boss can be stably controlled during the process of opening and closing the door 11.

The drive unit 300 according to an embodiment of the present disclosure may include a worm gear (310) structure to provide power for the movement of the push bar 150, the movable member 120, and the latch guide member 240. When the drive unit 300 includes the worm gear (310) structure, the load of the motor that generates power may be minimized by increasing the gear ratio of the drive unit 300. When the load of the motor is minimized, a low-cost motor may be used, which provides the advantage of minimizing the overall size of the drive unit 300. Furthermore, when the drive unit 300 includes the worm gear (310) structure, the operation of opening and closing the door 11 may be performed only by the drive unit 300 that provides power, and a user may be prevented from performing the operation of opening and closing the door 11 through an external force acting in the direction of the door 11. Accordingly, when the drive unit 300 includes the worm gear (310) structure, the erroneous operation performed by the user may be prevented, and the control of the opening and closing of the door 11 may be performed stably.

Figure 9:
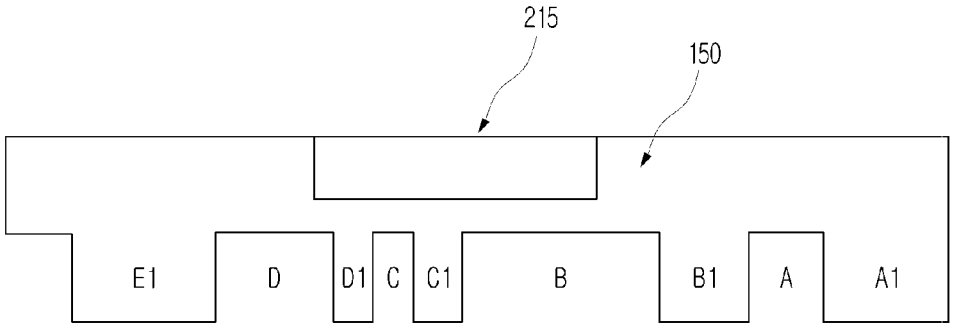
FIG. 9 is a side view schematically illustrating a portion of a push bar according to an embodiment of the present disclosure.

FIG. 9 is a side view schematically illustrating a portion of a push bar according to an embodiment of the present disclosure.

The push bar 150 according to an embodiment of the present disclosure may include a structure configured to generate changes in the signal to be detected by the second sensor 220. The push bar 150 may include a type of sawtooth structure in which a portion of the push bar 150 is repeatedly opened such that changes in the signal for the second reference point can be generated by the movement of the push bar 150. For example, referring to FIG. 9, the side wall of the push bar 150 may include a plurality of parts that input or block an optical signal to the second sensor 220. Part A1, part B1, part C1, part D1, and part E1 included in the side wall of the push bar 150 may block an optical signal from being input to the second sensor 220 fixedly disposed at the second reference point. Conversely, part A, part B, part C, and part D included in the side wall of the push bar 150 may allow an optical signal to be input to the second sensor 220 fixedly disposed at the second reference point. As the push bar 150 moves, each of the parts alternately passes the second reference point, thereby generating changes in the signal, such as the input or blocking of an optical signal. The second sensor 220 may detect these changes in the signal to check the opened/closed state of the door 11 and the operating state of the push bar 150.

In this case, each of the plurality of parts may have different lengths to distinguish between the degrees of changes in the optical signal. That is, in order to enable the opened/closed state of the door 11 to be accurately identified and recognized, the plurality of parts may be formed to have different lengths (or widths) and sizes, respectively. When the plurality of parts are formed to have different lengths and sizes, respectively, as described above, the control unit 240 may determine the degrees of changes in input or blocking on a time basis rather than determining simple changes in the signal, and may accurately determine the opened/closed state of the door 11 corresponding to each of the parts and a control signal for the opening/closing of the door 11. In other words, the control unit 240 may accurately determines whether the current opened/closed state of the door 11 is closed, fully opened, or partially opened through the plurality of parts having different lengths, respectively, and may control the drive unit 300.

Meanwhile, the lengths of the plurality of parts obtained by taking into consideration the roles of the plurality of parts, the sizes of the components included in the dishwasher, and the operation times for the opening and closing of the door 11 may be summarized as in Table 1 below:

TABLE 1

| Part | Description | Length | Estimated Time |
|---|---|---|---|
| A1 | push signal recognition part | 7.3 mm | 1000 ms to 5000 ms |
| A | closed state recognition part | 3.8 mm | 300 ms |
| B1 | forced opened state recognition part, part for recognition of closing operation in soft-close state | 5.2 mm | 350 ms |
| B | movement part | 10.0 mm | 650 ms |
| C1 | partially opened state recognition part, soft-close state recognition part | 3.2 mm | 230 ms |
| C | sensor displacement detection part | 1.5 mm | 120 ms |
| D1 | part for recognition of forced opened state in partially opened state | 2.5 mm | 180 ms |
| D | movement part | 6.2 mm | 450 ms |

Figure 10:
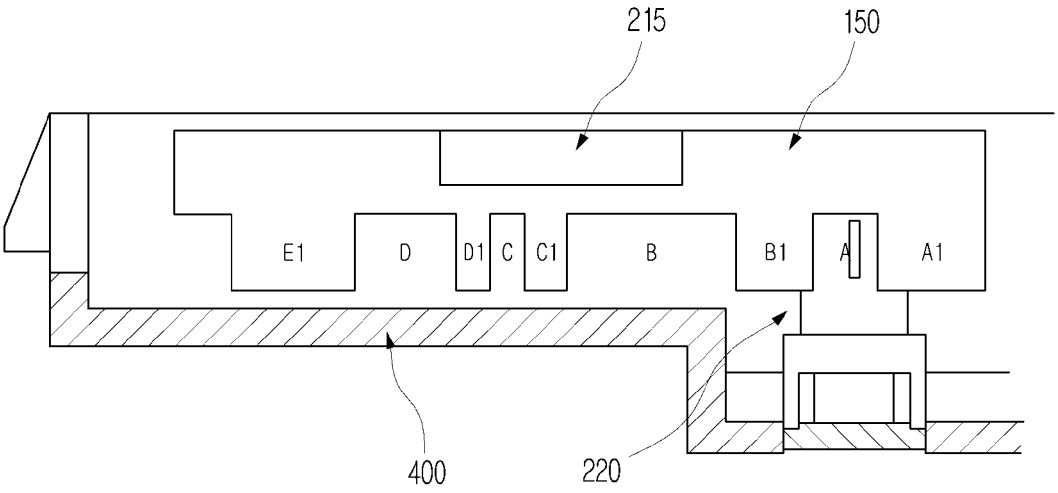
FIG. 10 is a side sectional view schematically illustrating the arrangement of the push bar in a first state according to an embodiment of the present disclosure.

FIG. 10 is a side sectional view schematically illustrating the arrangement of the push bar in a first state according to an embodiment of the present disclosure.

The control unit 240 according to an embodiment of the present disclosure may determine that a current state is a first state corresponding to a state in which the door 11 is closed based on the detection results of the first and second sensors 210 and 220. More specifically, the control unit 240 may determine that a current is the first state corresponding to a state in which the door 11 is closed when it is detected through the first sensor 210 that the push bar 150 has not deviated from the first reference point and it is also detected through the second sensor 220 that there is no change in the signal attributable to the movement of the push bar 150. For example, referring to FIG. 10, in the first state corresponding to a state in which the door 11 is closed, the first sensor 210 disposed at the first reference point may be in contact with the protrusion 215 of the push bar 150. In this case, the first sensor 210 may detect that the push bar 150 has not deviated from the first reference point. Furthermore, in the first state corresponding to a state in which the door 11 is closed, the second sensor 220 disposed at the second reference point is located on the same line as part A among the plurality of parts of the push bar 150. In this case, an optical signal is continuously input to the second sensor 220 through part A of the push bar 150 without any change, so that the second sensor 220 may detect that there is no change in the signal attributable to the movement of the push bar 150. The control unit 240 may recognize that part A of the push bar 150 is currently located at the second reference point by taking into consideration the time or width of the optical signal input to the second sensor 220 through part A. The control unit 240 may determine that a current is the first state corresponding to a state in which the door 11 is closed based on the detection results of the first and second sensors 210 and 220.

The control unit 240 may verify the determination for the first state based on the detection result of the third sensor 230. More specifically, when it is detected through the third sensor 230 that there is no change in the signal attributable to the movement of the movable member 120, the control unit 240 may determine that the determination for the first state is accurate. For example, in the first state corresponding to a state in which the door 11 is closed, the third sensor 230 disposed at the third reference point may be in a non-contact state without contact with the side wall of the movable member 120. In this case, the movable member 120 maintains a state in which it is not in contact with the third sensor 230 without any movement, so that the third sensor 230 can detect that there is no change in the signal attributable to the movement of the movable member 120. The control unit 240 may verify that the determination based on the first and second sensors 210 and 220 is accurate based on the detection result of the third sensor 230.

Figure 11:
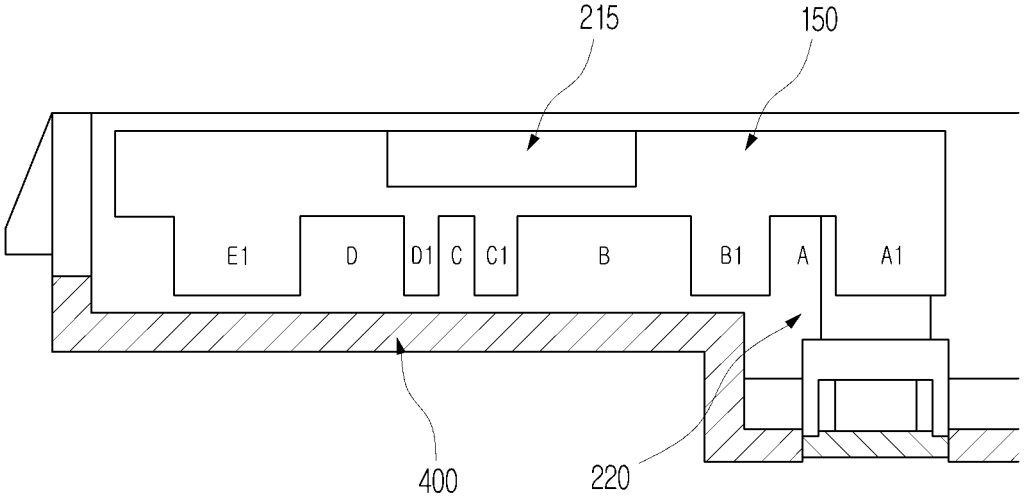
FIG. 11 is a side sectional view schematically illustrating the arrangement of the push bar during a process in which a push signal is input according to an embodiment of the present disclosure.

FIG. 11 is a side sectional view schematically illustrating the arrangement of the push bar during a process in which a push signal is input according to an embodiment of the present disclosure.

The control unit 240 according to an embodiment of the present disclosure may determine that a push signal intended to open the door 11 has been input based on the detection results of the first and second sensors 210 and 220. More specifically, when it is detected that the push bar 150 has not deviated from the first reference point through the first sensor 210 and changes in the signal attributable to the movement of the push bar 150 are detected as a first cycle through the second sensor 220, the control unit 240 may determine that a push signal intended to open the door 11 has been input. In this case, the first cycle may be understood as a repetition unit in which a signal is input to the second sensor, blocked, and then input again in response to the movement of the push bar 150. For example, referring to FIG. 11, when a push signal is input in the first state, the first sensor 210 disposed at the first reference point may still be in contact with the protrusion 215 of the push bar 150. In this case, the first sensor 210 may detect that the push bar 150 has not deviated from the first reference point. Furthermore, when a push signal for the door 11 is input in the first state, the location of the push bar 150 may change in sequence of part A, part A-1, and part A based on the second reference point. In this case, an optical signal is input to the second sensor 220 through part A of the push bar 150, blocked through part A-1, and then input again through part A, so that the second sensor 220 may detect that changes in the signal attributable to the movement of the push bar 150 are present as the first cycle. The control unit 240 may determine that a push signal intended to open the door 11 has been input based on the detection results of the first and second sensors 210 and 220.

The control unit 240 may verify whether a push signal has been input based on the detection result of the third sensor 230. More specifically, when it is detected through the third sensor 230 that there is no change in the signal attributable to the movement of the movable member 120, the control unit 240 may determine that the determination for the push signal is accurate. For example, when a push signal for the door 11 is input in the first state, the movable member 120 may maintain a state in which it is not in contact with the third sensor 230 without any movement despite the movement of the push bar 150. Accordingly, the third sensor 230 disposed at the third reference point may be in a non-contact state without contact with the side wall of the movable member 120. The third sensor 230 may detect that there is no change in the signal attributable to the movement of the movable member 120. The control unit 240 may determine that the determination based on the first and second sensors 210 and 220 is accurate based on the detection result of the third sensor 230 that is obtained on the assumption that the push signal has been input.

Figure 12:
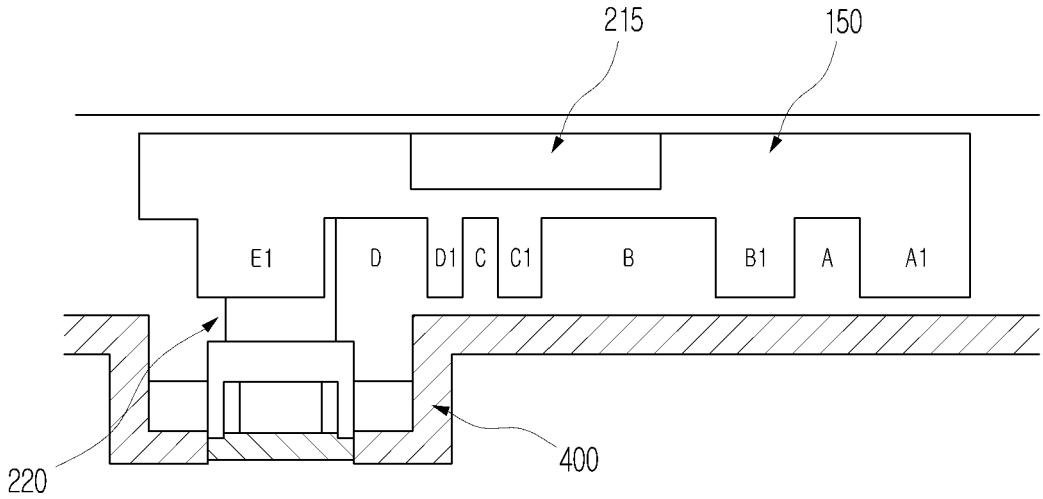
FIG. 12 is a side sectional view schematically illustrating the arrangement of the push bar in a second state according to an embodiment of the present disclosure.

FIG. 12 is a side sectional view schematically illustrating the arrangement of the push bar in a second state according to an embodiment of the present disclosure.

The control unit 240 according to an embodiment of the present disclosure determines that a current state is a second state corresponding to a state in which the door 11 is fully opened based on the detection results of the first and second sensors 210 and 220. More specifically, the control unit 240 may detect that the push bar 150 has deviated from the first reference point through the first sensor 210 when a push signal has been input in the first state, and may determine that a current state is the second state corresponding to a state in which the door 11 is fully opened when changes in the signal attributable to the movement of the push bar 150 are detected as a second cycle through the second sensor 220. In this case, the second cycle is understood as a unit in which the cycle in which a signal is input to the second sensor 220 and then blocked is repeated N times in response to the movement of the push bar 150 when a push signal is input in the first state. Furthermore, N may be a predetermined natural number of 3 or more. For example, referring to FIG. 12, when a push signal is input in the first state and switched to the second state, the first sensor 210 disposed at the first reference point may be switched from a state of being in contact with the protrusion 215 of the push bar 150 to a non-contact state. In this case, the first sensor 210 may detect that the push bar 150 has deviated from the first reference point. Furthermore, when a push signal is input in the first state and switched to the second state, the location of the push bar 150 may be changed in sequence from part A to part E1 based on the second reference point. In this case, the cycle in which an optical signal is input to the second sensor 220 and then blocked through parts A to E1 of the push bar 150 is repeated four times, so that the second sensor 220 may detect that changes in the signal attributable to the movement of the push bar 150 are present as the second cycle. The control unit 240 may determine that a current state is the second state corresponding to a state in which the door 11 is fully opened based on the detection results of the first and second sensors 210 and 220.

The control unit 240 may verify the determination for the second state based on the detection result of the third sensor 230. More specifically, when the push signal is input in the first state and it is detected that the cycle in which a signal is blocked and then input to the third sensor 230 is repeated twice in response to the movement of the movable member 120, the control unit 240 may determine that the determination for the second state is accurate. For example, when the push signal is input in the first state and switched to the second state, the movable member 120 is also moved in response to the movement of the push bar 150, so that a state in which the movable member 120 and the third sensor 230 are in contact with each other may be changed. That is, when the push signal is input in the first state and switched to the second state, a state in which the movable member 120 and the third sensor 230 are not in contact with each other and a state in which the movable member 120 and the third sensor 230 are in contact with each other may be repeated twice sequentially. In this case, the third sensor 230 may detect that the cycle in which a signal is blocked and then input has been repeated twice from the first state. The control unit 240 may determine that the determination based on the first and second sensors 210 and 220 is accurate based on the detection result of the third sensor 230 that is obtained on the assumption that switching to the second state is performed.

Figure 13:
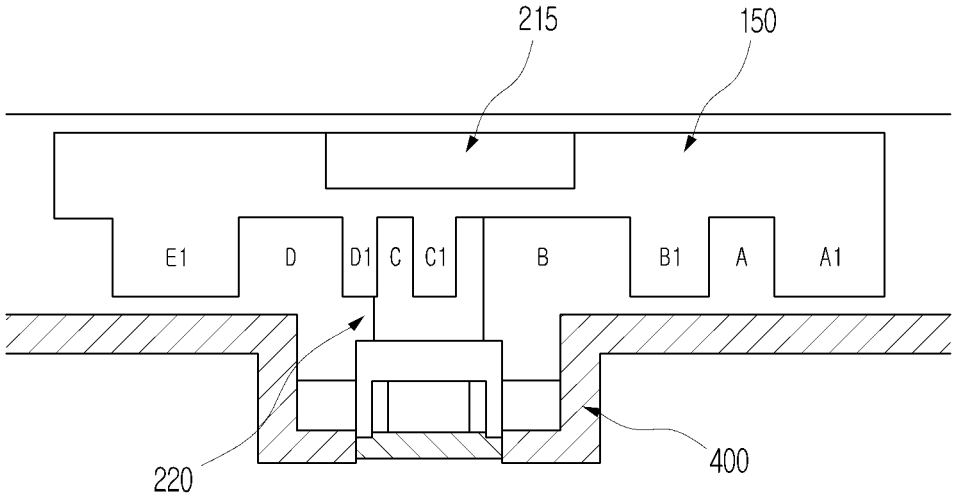
FIG. 13 is a side sectional view schematically illustrating the arrangement of the push bar in a third or fourth state according to an embodiment of the present disclosure.

FIG. 13 is a side sectional view schematically illustrating the arrangement of the push bar in a third or fourth state according to an embodiment of the present disclosure.

The control unit 240 according to an embodiment of the present disclosure may determine that a current state is the second state corresponding to a state in which the door 11 is fully opened based on the detection results of the first and second sensors 210 and 220. More specifically, when it is detected through the first sensor 210 that the push bar 150 has deviated from the first reference point and changes in the signal attributable to the movement of the door 11 are detected as a third cycle through the second sensor 220 in the second state, the control unit 240 may determine that a current state is a third state in which a soft-close operation intended to automatically close the door 11 is required. In this case, the third cycle may be understood as a unit in which the cycle in which a signal is input to the second sensor 220 and then blocked is repeated M times in response to the movement of the push bar 150 from the second state. Furthermore, M may be a predetermined natural number smaller than N. For example, referring to FIG. 13, in the case of an intermediate state in which a current state is not completely switched from the second state to the first state by an external force acting on the door 11, the first sensor 210 disposed at the first reference point may be in a non-contact state without contact with the protrusion 215 of the push bar 150. In this case, the first sensor 210 may detect that the push bar 150 has deviated from the first reference point. Furthermore, in the case of the intermediate state in which a current state is not completely switched from the second state to the first state by an external force acting on the door 11, the location of the push bar 150 may be changed in sequence from part E1 to part C1 based on the second reference point. In this case, the cycle in which an optical signal is input to the second sensor 220 and then blocked through part E1 to part C1 of the push bar 150 is repeated twice, so that the second sensor 220 may detect that changes in the signal attributable to the movement of the push bar 150 are present as the third cycle. The control unit 240 may determine that a current state is the third state in which a soft-close operation intended to automatically close the door 11 is required based on the detection results of the first and second sensors 210 and 220.

The control unit 240 may verify the determination for the third state based on the detection result of the third sensor 230. More specifically, when it is detected that a signal is input to the third sensor 230, blocked, and then input again in response to the movement of the movable member 120 from the second state, the control unit 240 may determine that the determination for the third state is accurate. For example, in the case of an intermediate state in which a current state is not completely switched from the second state to the first state by an external force acting on the door 11, the movable member 120 is also moved in response to the movement of the push bar 150, so that a state in which the member 120 and the third sensor 230 are in contact with each other may be changed. That is, in the case of the intermediate state in which a current state is not completely switched from the second state to the first state by an external force acting on the door 11, a state in which the member 120 and the third sensor 230 are in contact with each other and a state in which the member 120 and the third sensor 230 are not in contact with each other may be repeated twice. In this case, the third sensor 230 may detect that a signal is input, blocked, and then input again from the second state. The control unit 240 may verify that the determination based on the first and second sensors 210 and 220 is accurate based on the detection result of the third sensor 230 that is obtained on the assumption that switching to the third state is performed.

When the determination and the verification for the third state are completed, the control unit 240 may control the drive unit 300 to perform a soft-close operation. The soft-close operation may be understood as a function that allows the door 11 to be automatically closed in such a manner that the control unit 240 controls the drive unit 300 without a separate external force. Accordingly, when the determination and the verification for the third state are completed, the control unit 240 may control the drive unit 300 to operate components for opening and closing the door 11, such as the push bar 150, in order to implement a soft-close operation for completely switching the door 11 to the first state.

Meanwhile, the control unit 240 according to an embodiment of the present disclosure may determine that a current state is a fourth state corresponding to a state in which the door 11 is partially opened based on the detection results of the first and second sensors 210 and 220. More specifically, when a dishwasher is in a predetermined drying cycle, it is detected through the first sensor 210 that the push bar 150 has deviated from the first reference point, and changes in the signal attributable to the movement of the push bar 150 are detected as the fourth cycle through the second sensor 220, the control unit 240 may determine that a current state is the fourth state corresponding to a state in which the door 11 is partially opened. In this case, the fourth cycle may be understood as a unit in which the cycle in which a signal is input to the second sensor 220 and then blocked is repeated K times in response to the movement of the push bar 150 when the dishwasher is in a predetermined drying cycle. Furthermore, K may be a predetermined natural number smaller than N. For example, referring to FIG. 13, when the dishwasher starts a predetermined drying cycle in the first state, the first sensor 210 disposed at the first reference point may be switched from a state of being in contact with the protrusion 215 of the push bar 150 to a non-contact state. In this case, the first sensor 210 may detect that the push bar 150 has deviated from the first reference point. Furthermore, when the dishwasher starts a predetermined drying cycle in the first state, the location of the push bar 150 may be changed in sequence from part A to part C1 based on the second reference point. In this case, the cycle in which an optical signal is input to the second sensor 220 and then blocked through parts A to C1 of the push bar 150 is repeated twice, so that the second sensor 220 can detect that changes in the signal attributable to the movement of the push bar 150 are present as the fourth cycle. The control unit 240 may determine that a current state is the fourth state corresponding to a state in which the door 11 is partially opened based on the detection results of the first and second sensors 210 and 220.

The control unit 240 may verify the determination for the fourth state based on the detection result of the third sensor 230. More specifically, when the dishwasher is in a predetermined drying cycle and it is detected that the cycle in which a signal is blocked and input to the third sensor 230 is repeated twice in response to the movement of the movable member 120, the control unit 240 may determine that the above determination for the fourth state is accurate. For example, when the dishwasher starts a predetermined drying cycle in the first state, the movable member 120 is also moved in response to the movement of the push bar 150, so that a state in which the movable member 120 and the third sensor 230 are in contact with each other may be changed. That is, when the dishwasher starts a predetermined drying cycle in the first state, a state in which the movable member 120 and the third sensor 230 are not in contact with each other and a state in which the movable member 120 and the third sensor 230 are in contact with each other may be repeated twice sequentially. In this case, the third sensor 230 may detect that the cycle in which a signal is blocked and then input has been repeated twice from the first state. The control unit 240 may verify that the determination based on the first and second sensors 210 and 220 is accurate based on the detection result of the third sensor 230 that is obtained on the assumption that a current cycle is a predetermined drying cycle.

When a predetermined drying cycle is completed in the fourth state, the control unit 240 may control the drive unit 300 to switch the opened/closed state of the door 11 to the first state. When the fourth state is maintained even after the completion of the drying cycle, a problem may arise in that foreign materials present outside the dishwasher may flow into the inside of the dishwasher, thus causing dishes to become contaminated again. Accordingly, in order to solve this problem, when the drying cycle is completed in the fourth state, the control unit 240 may control the drive unit 300 so that the door 11 can be switched to a fully closed state.

Figure 14:
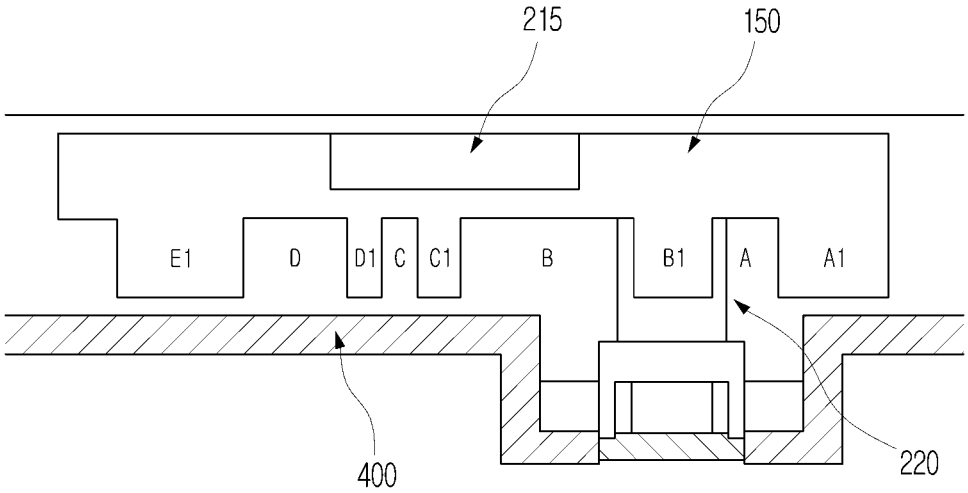
FIG. 14 is a side sectional view schematically illustrating the arrangement of the push bar in a fifth state according to an embodiment of the present disclosure.

FIG. 14 is a side sectional view schematically illustrating the arrangement of the push bar in a fifth state according to an embodiment of the present disclosure.

The control unit 240 according to an embodiment of the present disclosure may determine that a current state is a fifth state in which the door 11 needs to be forcibly opened based on the detection results of the first and second sensors 210 and 220. More specifically, when it is detected through the first sensor 210 that the push bar 150 has deviated from the first reference point and it is detected that a signal is input to the second sensor 220 and then blocked in response to the movement of the push bar 150 from the third or fourth state, the control unit 240 may determine that a current state is the fifth state in which the operation of forcibly opening the door 11 is required. The fifth state may be understood as a state in which a foreign object or a user's body is caught in the door 11 during a process of switching from the third or fourth state to the first state. In other words, the fifth state may be understood as a state in which the door 11 cannot be completely closed due to an external obstruction factor.

For example, referring to FIG. 14, when a foreign object is caught in the door 11 during a process of switching from the third or fourth state to the first state, the first sensor 210 disposed at the first reference point may be in a non-contact state without contact with the protrusion 215 of the push bar 150. In this case, the first sensor 210 may detect that the push bar 150 has deviated from the first reference point. Furthermore, when a foreign object is caught in the door 11 during the transition from the third or fourth state to the first state, the location of the push bar 150 may be changed in sequence from part B to part B1 based on the second reference point. In this case, an optical signal is input to the second sensor 220 and then blocked through part B to part B1 of the push bar 150, so that the second sensor 220 may detect that a signal is input and then blocked in response to the movement of the push bar 150. The control unit 240 may determine that a current state is the fifth state in which the door 11 needs to be forcibly opened based on the detection results of the first and second sensors 210 and 220.

The control unit 240 may verify the determination for the fifth state based on the detection result of the third sensor 230. More specifically, when it is detected through the third sensor 230 that there is no change in the signal attributable to the movement of the movable member 120 in a state adjacent to the first state, the control unit 240 may determine that the determination for the fifth state is accurate. For example, in the fifth state in which the door 11 needs to be forcibly opened, the third sensor 230 disposed at the third reference point may be in a non-contact state without contact with the side wall of the movable member 120. In this case, the movable member 120 maintains a state of being not in contact with the third sensor 230 without any movement, so that the third sensor 230 can detect that there is no change in signal attributable to the movement of the movable member 120. The control unit 240 may determine that the determination based on the first sensor 210 and the second sensor 220 is accurate based on the detection result of the third sensor 230.

When the determination and the verification for the fifth state are completed, the control unit 240 may control the drive unit 300 to switch the opened/closed state of the door 11 to the second state or fourth state. That is, the control unit 240 may control the drive unit 300 to switch a current state to the second state, which is a fully open state, by forcibly opening the door 11. Furthermore, the control unit 240 may control the drive unit 300 to switch a current state to the fourth state, which is a partially open state, by forcibly opening the door 11.

The detection results of the sensors 210, 220 and 230 for respective signals and the opened/closed states of the door 11 and the determinations of the control unit 240 for the opened/closed states of the door 11, which are described based on FIGS. 10 to 14, may be summarized as shown in Table 2 below. In Table 2, "on" may be understood as a term indicating a state in which one of the sensors 210, 220 and 230, which are contact switches, is in contact with the push bar 150 or the movable member 120. In contrast, "off" may be understood as a term indicating a state in which one of the sensors 210, 220 and 230, which are contact switches, is not in contact with the push bar 150 or the movable member 120.

TABLE 2

| | First sensor 210 | Second sensor 220 | Third sensor 230 |
|---|---|---|---|
| First state | on | light input | off |
| Push signal | on | light input -> light blocked -> light input | off |

TABLE 2-continued

| | First sensor 210 | Second sensor 220 | Third sensor 230 |
|---|---|---|---|
| Second state | off | light input -> light blocked -> light input -> light blocked -> light input -> light blocked -> light input -> light blocked | off -> on -> off -> on |
| Third state | off | (from second state) light input -> light blocked -> light input -> light blocked | (from second state) on -> off -> on |
| Closing operation | off -> on | (case where door is closed in third state) light blocked -> light input | off |
| Fourth state | off | light input -> light blocked -> light input -> light blocked | off -> on -> off -> on |
| Fifth state | off | light input -> light blocked | off |

Figure 15:
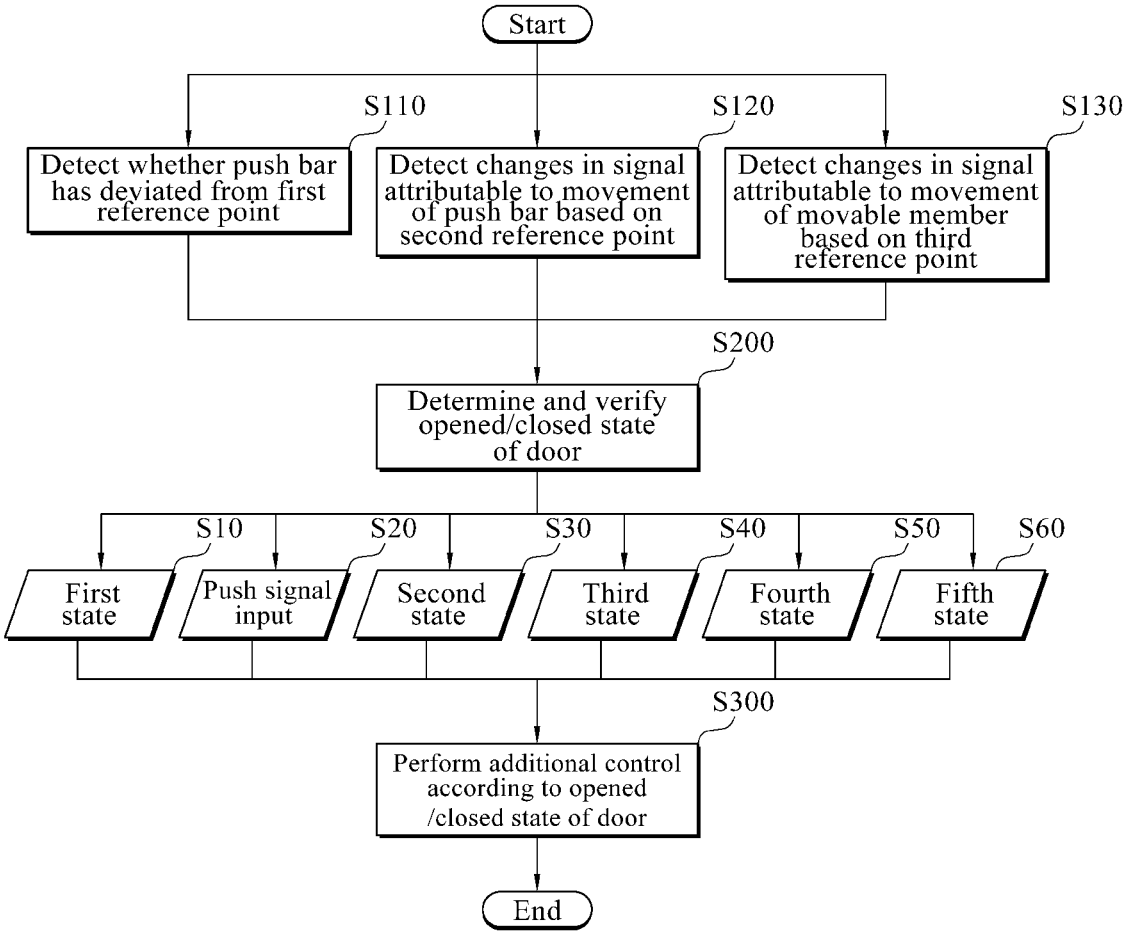
FIG. 15 is a flowchart showing a method according to an embodiment of the present disclosure.

FIG. 15 is a flowchart showing a method according to an embodiment of the present disclosure.

The device 100 according to an embodiment of the present disclosure may perform a method for determining the opened/closed state of the door 11 and a control signal for opening/closing the door 11. Referring to FIG. 15, the device 100 may detect whether the push bar 150 for opening and closing the door 11 has deviated from the first reference point in step S110. Furthermore, the device 100 may detect changes in the signal attributable to the movement of the push bar 150 based on the second reference point that is different from the first reference point in step S120. Furthermore, the device 100 may detect changes in the signal attributable to the movement of the movable member 120, to which the push bar 150 can be coupled, based on the third reference point that is different from the second reference point in step S130. Steps S110 to S130 may be performed in parallel, as shown in FIG. 15.

The device 100 may determine and verify the opened/closed state of the door 11 based on at least one of the result of step S110, the result of step S120, or the result of step S130 in step S200. More specifically, the device 100 may determine the opened/closed state of the door 11 to be any one of the first state S10 corresponding to the complete closing of the door 11, the state S20 in which a push signal is input, the second state S30 corresponding to the complete opening of the door 11, the third state S40 requiring a soft-close operation for the door 11, the fourth state S50 corresponding to the partial opening of the door 11, and the fifth state S60 requiring the forced opening of the door 11, and may verify the determination. During the determination and verification process, the control operation for the opening and closing of the door 11 may be continuously performed. In addition to the above-described states, all opened/closed states of the door 11 that can be implemented within the range in which they can be understood by those skilled in the art based on the description of the present disclosure may be included in the opened/closed state of the present disclosure.

Once the determination and verification of each state is completed, the device 100 may perform additional control according to the opened/closed state of the door 11 in step S300. For example, when it is determined and verified that a current state is the fifth state S60 requiring the forced opening of the door 11, the device 100 may move the push bar 150 rearward by controlling the drive unit 300 so that the door 11 can be completely opened or partially opened. When additional control is not required, the device 100 may end the overall control operation without performing additional control.

The present disclosure can provide the dishwasher and the door control method for a dishwasher that can accurately determine and control the opened/closed state of the door. Furthermore, the present disclosure can provide the control device and method that enable air to circulate smoothly during the process of drying and storing dishes in the dishwasher.

Moreover, according to an embodiment of the present disclosure, after all cycles of the dishwasher are completed, not only the automatic door opening function but also the automatic door closing function can be selected and implemented. Accordingly, after a drying cycle is completed, the automatic door opening function is used to remove residual moisture and odor inside the washing machine, and the automatic door closing function is used to prevent t surrounding dust or foreign materials from entering the washing machine, thereby preventing the recontamination of dishes.

Referring to FIG. 7, the dishwasher 1000 according to an embodiment of the present disclosure may include a door 11, a push bar 150 configured to move in the opening and closing directions of the door 11, a movable member 120 configured to be coupled to the push bar 150, and a drive unit 300 configured to provide power for the movement of the push bar 150. Furthermore, The dishwasher 1000 may include a first sensor 210 configured to detect whether the push bar 150 has deviated from a first reference point, a second sensor 220 configured to detect changes in the signal attributable to the movement of the push bar 150 based on a second reference point that is different from the first reference point, and a third sensor 230 configured to detect changes in the signal attributable to the movement of the movable member 120, to which the push bar 150 can be coupled, based on a third reference point that is different from the second reference point.

Furthermore, the dishwasher 1000 may include a control device 100 for drying and managing dishes. The device 100 may include an air supply unit 510 introducing hot air into the dishwasher (1000) for drying the dishes. And the device 100 may include a sanitizing unit for removing bacteria and the like present on the dishes. However, FIG. 7 is only an example, and thus only some of the components disclosed above may be included in the device 100 of the present disclosure. Furthermore, the first sensor 210, the second sensor 220, the third sensor 230 may be included in the device 100 of the present disclosure.

The air supply unit 510 according to the present embodiment may and supply the hot air into the dishwasher 1000, which is generated by purifying the air outside of the dishwasher 1000. That is, the air supply unit 510 may serve to introduce the purified hot air into the dishwasher 1000 to dry the dishes through evaporation. For example, the air supply unit 510 may include a heater for generating hot air and a filter for purifying the hot air. The heater may heat the air that is introduced into the dishwasher 1000 to a preset temperature or higher. The filter may remove fine dust or other particles present in the air that is introduced into the dishwasher 1000.

The control unit 240 according to an embodiment of the present disclosure can control the entirety of the post-wash drying and storage cycle of the dishes. The control unit 240 may control configurations and perform drying cycle to facilitate the evacuation of moisture present inside the dishwasher 1000 after the end of the washing cycle.

Additionally, for addressing issues such as odor generation that may occur as the dishes are stored, the control unit 240 may control the configurations to perform a ventilation cycle after the drying cycle ends to purify or otherwise circulate air present inside the dishwasher 1000 to the outside. For example, after completion of the wash cycle the control unit 240 may pause the entire cycle for a predetermined amount of time to evaporate moisture from the dishes. The control unit 240 may control the door 11 of the dishwasher 1000 to be partially open to allow water vapor to escape to the outside of the dishwasher 1000. The control unit 240 may introduce purifying hot air generated by the air supply unit 510 into the interior of the dishwasher 1000 to dry the dishes. The control unit 240 may then ventilate the air inside the dishwasher 1000 at a predetermined interval. Further, the control unit 240 may operate the sanitizing unit 530 to remove bacteria or the like present on the dishes during the process of drying the dishes or ventilating the interior air of the dishwasher 1000.

The sanitizing unit 530 according to an embodiment of the present disclosure may radiate ultraviolet light to the dishes to kill bacteria or the like present on the dishes. The sterilization unit 530 may be provided in a tub in which the dishwasher 1000 is stored. For example, the sanitizing section 530 may include a lamp or light emitting diode (LED) that emits UV-C, an ultraviolet germicidal wavelength.

Figure 16:
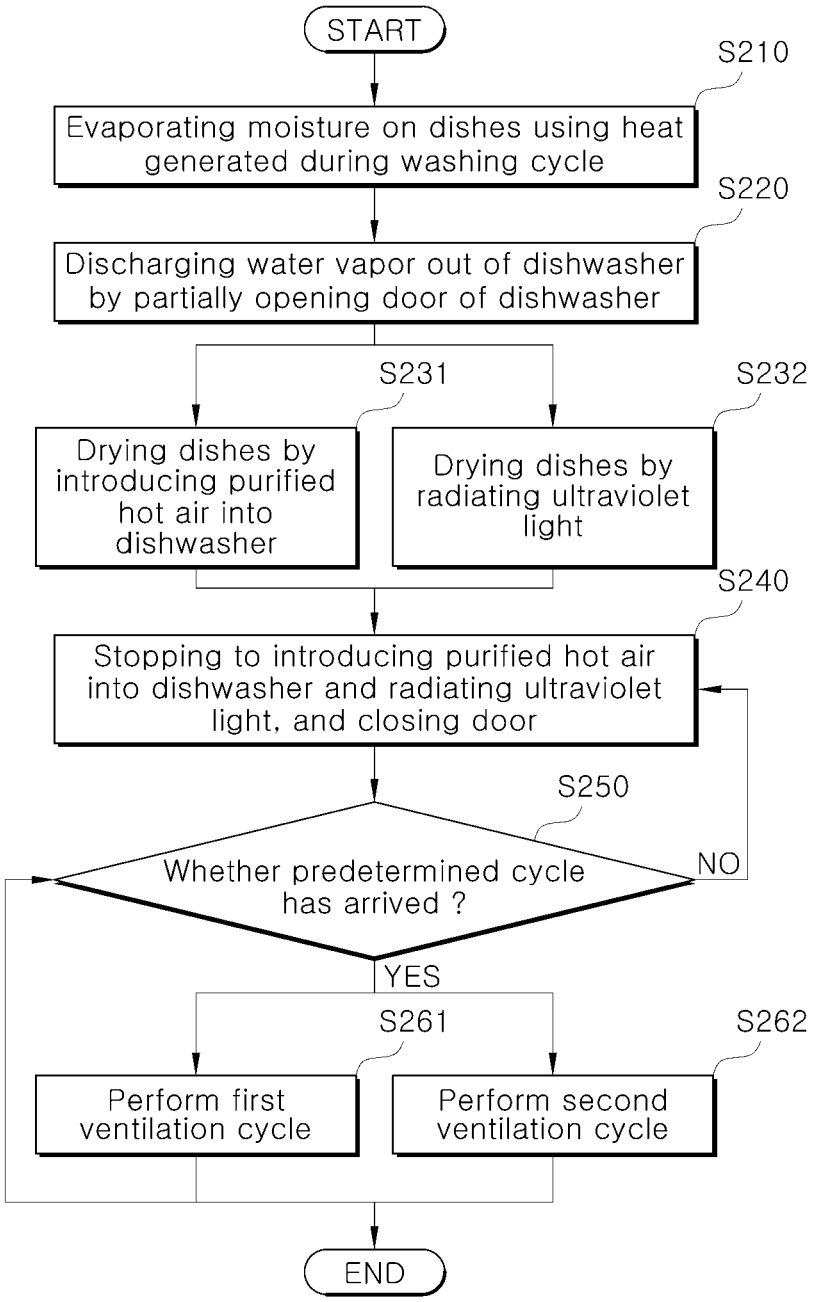
FIG. 16 is a flowchart illustrating a control method for drying and managing dishes in a dishwasher according to an embodiment of the present disclosure.

FIG. 16 is a flowchart illustrating a control method for drying and managing dishes in a dishwasher according to an embodiment of the present disclosure.

Referring to FIG. 16, The control unit 240 according to an embodiment of the present disclosure may utilize the heat generated along the washing cycle to evaporate moisture from the dishes in step S210. For example, at the end of the washing cycle, the control unit 240 may stop the entire cycle for a predetermined amount of time. At this time, the door 11 of the dishwasher is in a closed state, so the control unit 240 can utilize the residual heat energy generated by the washing cycle to evaporate the moisture remaining in the dishes. In other words, by stopping the entire operation of the dishwasher 1000 for a first hour after the washing cycle, the control unit 240 can perform latent heat drying, in which the moisture remaining in the dish is evaporated through the heat generated by the washing cycle. In this case, the first time period may be a predetermined time period by a control algorithm based on the capacity of the dishwasher 1000, the wash time, and the like.

After step S210 has been performed for the first hour, the control unit 240 may open a portion of the door 11 to vent water vapor to the outside in the step S220. The control unit 240 may open the door 11 only partially, rather than fully, to minimize debris from entering the dishwasher 1000 while simultaneously exhausting the water vapor. In addition, the control unit 240 may operate the air supply 510 to introduce purifying hot air into the interior of the dishwasher 1000 and dry the dishes in step S231. The control unit 240 may utilize the purifying hot air, which is free of fine dust and other particles, to rapidly evaporate the remaining moisture in the dishes and allow the dishes to remain clean. That is, the control unit 240 may open a portion of the door 11 for a second time after step S210 and introduce the purifying hot air into the interior of the dishwasher 1000 to rapidly discharge the water vapor remaining after step S210 is performed, and efficiently evaporate the remaining moisture in the dishes through the hot air. In this case, the second time may be a predetermined time based on a control algorithm in accordance with the capacity of the dishes stored in the dishwasher 1000, the humidity inside the dishwasher 1000, and the like.

On the other hand, in the process of performing steps S220 and S231, the control unit 240 may dry the dishes by emitting ultraviolet light to the dishes through the sterilization unit 530. In order to block the problem of contamination by bacteria that may occur in the process of performing the steps S220 and S231, the control unit 240 may emit ultraviolet light to the dishes for a second time after the step S210 to eliminate bacteria and the like that may be present in the dishes. In other words, the control unit 240 may use the sterilization unit 530 to enable the drying cycle (including the steps S220 and S231) to be performed more effectively after the washing cycle. After the drying cycle has been performed for the second hour following the washing cycle, the control unit 240 may stop the steps S231 (introducing purifying hot air) and S232 (radiating ultraviolet light), and may close the partially open door 11 in step S240. The control unit 240 may fully close the partially open door 11 for safe storage of the utensils after the drying cycle is completed. By fully closing the partially open door 11 after the drying cycle, the control unit 240 may prevent external contaminants from entering.

After the door 11 is fully closed, the control unit 240 may determine whether a predetermined number of cycles have elapsed since the door 11 was fully closed in step S250. In this case, the predetermined cycle may be a time predetermined by a control algorithm based on the capacity of the dishes stored in the dishwasher 1000, the humidity of the dishwasher 1000, and the like. If the predetermined cycle has not elapsed, the control unit 240 may continuously determine whether the predetermined cycle has elapsed without further control. If the predetermined period has elapsed, the control unit 240 may perform a ventilation cycle to ventilate the air inside the dishwasher 1000 in steps S261 and S262. If the dishes are continuously stored with the door 11 fully closed, the internal air of the dishwasher 1000 may become contaminated, which may affect the odor of the dishes and the like. Therefore, it is necessary to periodically ventilate the interior of the dishwasher 1000 to suppress odor generation, and the control unit 240 may periodically determine whether a predetermined cycle has arrived in the process of storing the dishes and perform the ventilation cycle to purify or circulate the interior air of the dishwasher 1000.

Specifically, the control unit 240 may perform at least one of a first ventilation cycle using purifying hot air, or a second ventilation cycle using natural drying, at a predetermined interval in step S261 and S262. The first ventilation cycle may be a cycle to circulate the air inside the dishwasher 1000 by introducing purifying hot air into the interior of the dishwasher 1000. That is, the control unit 240 may operate the air supply unit 510 to perform the first ventilation cycle to purify the air inside the dishwasher 1000 by introducing purifying hot air into the interior in step S261. The control unit 240 may also exhaust some of the internal air of the dishwasher 1000 through a duct included in the air supply unit 510 during the first ventilation cycle. The second ventilation cycle may be a cycle to partially open the door 11 to circulate the internal air of the dishwasher 1000, that is, the control unit 240 may perform a second ventilation cycle to partially open the door 11 to allow natural ventilation to occur through a circulation process in which outside air enters and inside air exits in step S262. The control unit 240 may periodically perform at least one of the first ventilation cycle or the second ventilation cycle based on predetermined conditions. For example, when a predetermined number of cycles have passed since the door 11 was closed, the control unit 240 may perform the first ventilation cycle. At this time, if an abnormality occurs in the air supply unit 510 in the process of performing the first ventilation cycle and it fails to operate properly, the control unit 240 may perform a second ventilation cycle along with the first ventilation cycle. However, the above-described ventilation cycle method is only an example, and the present disclosure is not limited thereto.

In the control method of the present disclosure described above with reference to FIG. 16, in the drying cycle, the drying efficiency can be improved by smoothly discharging moisture, and the dishes can be dried with low noise and low power by supplying hot air at a lower pressure than in the conventional method.

Furthermore, the control method of the present disclosure described above with reference to FIG. 16 can effectively prevent recontamination of dishes by blocking external contaminants from entering and periodically ventilating the interior of the dishwasher with clean air in the cycle of storing and managing dishes after the drying cycle.

Figure 17:
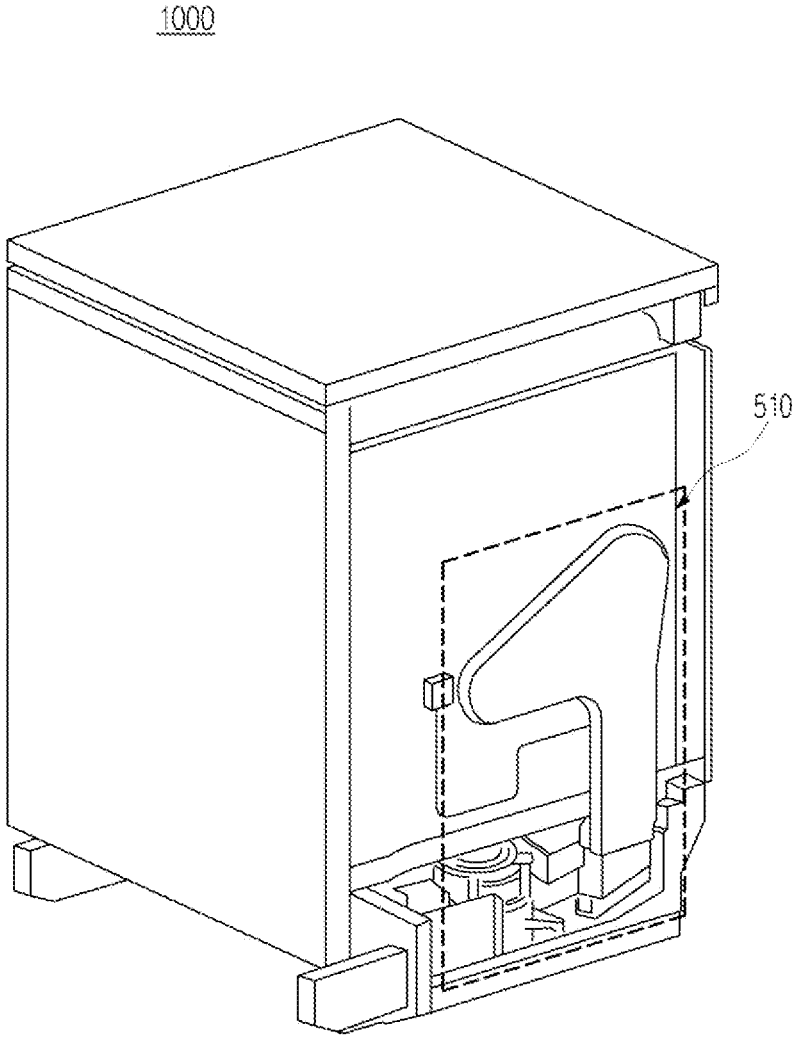
FIG. 17 is a rear perspective view of an air supply provided in a dishwasher according to an embodiment of the present disclosure.
Figure 18:
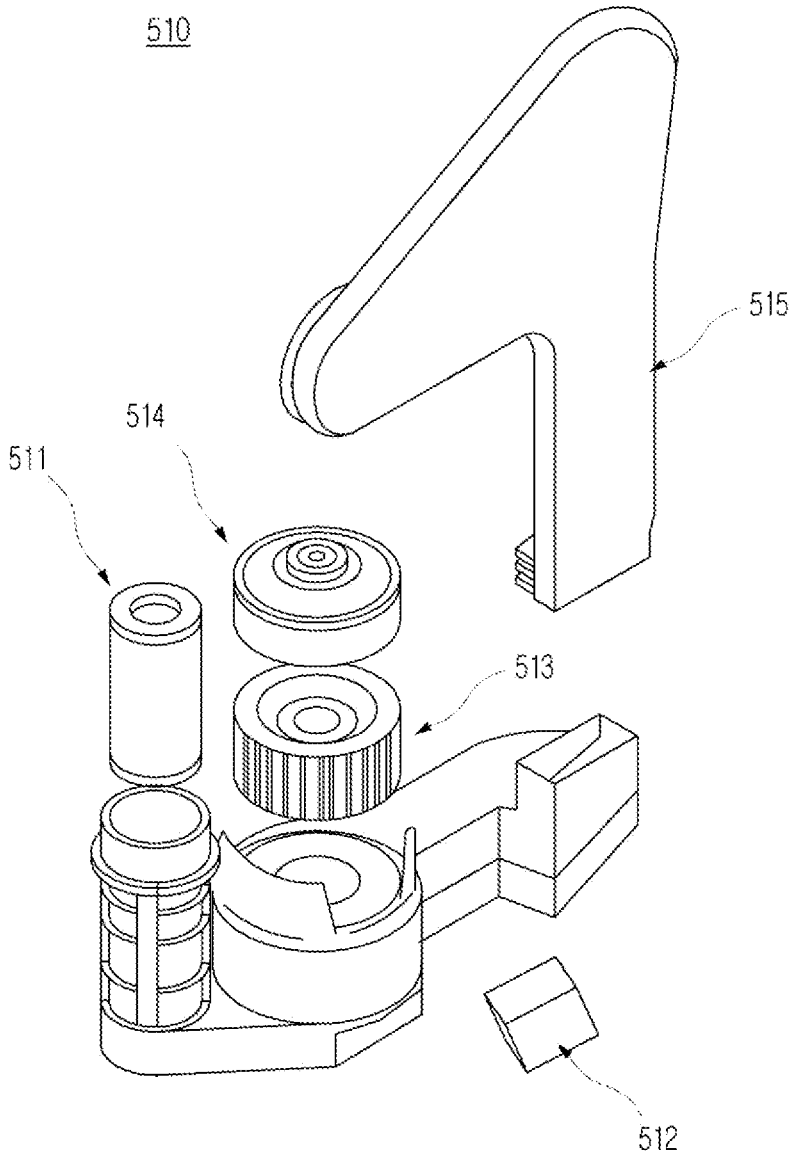
FIG. 18 is an exploded view of an air supply according to an embodiment of the present disclosure.

FIG. 17 is a rear perspective view of an air supply provided in a dishwasher according to an embodiment of the present disclosure, and FIG. 18 is an exploded view of an air supply according to an embodiment of the present disclosure.

Referring to FIG. 17, the air supply unit 510 according to an embodiment of the present disclosure may be provided at the rear of the dishwasher 1000. That is, the air supply unit 510 may be mounted at the rear of the dishwasher 1000 to serve to provide clean hot air during a drying cycle of the dishwasher 1000. In this case, although not shown in FIG. 17, the rear of the dishwasher 1000 may be provided with a cover for protection of the air supply unit 510.

Referring to FIG. 18, the air supply unit 510 according to an embodiment of the present disclosure includes an air filter 511 to purify the air to be supplied inside the dishwasher 1000, a heater 512 to heat the air to be supplied inside the dishwasher 1000, an impeller 513 to generate fluid motion of the air to be supplied inside the dishwasher 1000, a motor 514 to provide power for the motion of the impeller, and a duct 515 that is a passageway through which the air to be supplied inside or outside the dishwasher 1000 flows. The air supply unit 510 may utilize the motor 514 to operate the impeller 513 to generate a flow of air within the air supply unit 510 to be supplied into the dishwasher 1000. The air traveling along the air stream created by the impeller 513 may be purified through an air filter 511 and heated through a heater 512. The purified hot air generated by this process may be supplied through duct 515 and into the dishwasher 1000, where it may be used to dry dishes. However, since FIG. 18 is only an example, only some of the above-disclosed configurations may be included in the air supply 510 of the present disclosure.

Figure 19:
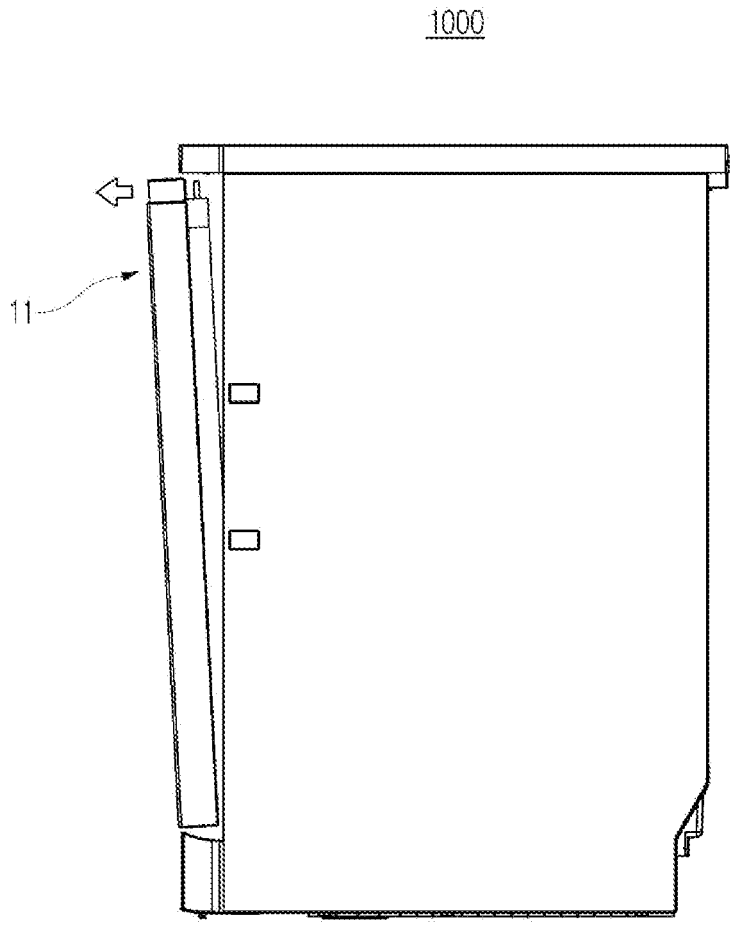
FIG. 19 is a side view illustrating a partially opened door of a dishwasher according to an embodiment of the present disclosure.
Figure 20:
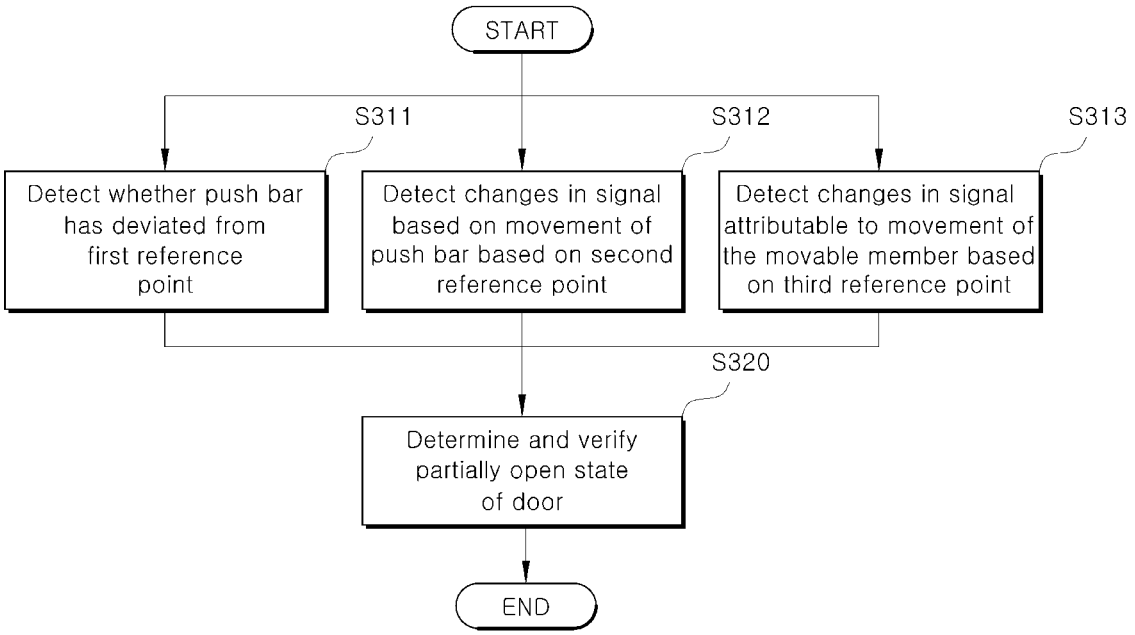
FIG. 20 is a flowchart illustrating a control method for partially opening a door of a dishwasher according to an embodiment of the present disclosure.

FIG. 19 is a side view illustrating a partially opened door of a dishwasher according to an embodiment of the present disclosure, and FIG. 20 is a flowchart illustrating a control method for partially opening a door of a dishwasher according to an embodiment of the present disclosure.

The control unit 240, according to one embodiment of the present disclosure, may partially open the door 11 of the dishwasher 1000 for a drying cycle or a ventilation cycle. By opening a portion of the door 11, it may be understood that the door 11 is opened to form a space sufficient to allow air to flow. For example, when the control unit 240 is performing an cycle of drying the utensils with heat generated by a washing cycle, an cycle of drying the utensils using purifying hot air flowing through the air supply 510, or a second ventilation cycle, the door 11 may be opened to form a gap to the extent that air inside can escape to the outside, as shown in FIG. 19. This degree of opening of the door 11 may be regulated by the control unit 240, which controls components included in the dishwasher 1000, such as the push bar 150 and the drive unit 300.

Specifically, referring to FIG. 20, to determine and control a partially open state of the door 11, the first sensor 210 may detect whether the push bar 150 for opening and closing the door 11 has deviated from a first reference point in step S311. Further, the second sensor 220 may detect a change in the signal based on a movement of the push bar 150, based on a second reference point different from the first reference point in step S312. Further, the third sensor 230 may detect a change in the signal based on a movement of the movable member 120 to which the push bar 150 is engageable, based on a third reference point different from the second reference point in step S313. Steps S311 through S313 may be performed in parallel, as shown in FIG. 9.

Based on at least one of the results of step S311, the results of step S312, or the results of step S313, the control unit 240 may determine and verify a partially open state of the door 11 in step S320. For example, the control unit 240 may determine that the door 11 is in a partially open state if, when the dishwasher 1000 is in a particular cycle, it is detected through the first sensor 210 that the push bar 150 has left a first reference point, and a signal is input to the second sensor 220 based on the movement of the push bar 150 and the cycle of being blocked has been repeated twice. Furthermore, the control unit 240 may determine that the above judgment of the partially open state is correct if, when the dishwasher 1000 is in a particular cycle, it is detected that the cycle in which the signal is blocked and input to the third sensor 230 is repeated twice according to the movement of the movement member 120. In this case, the particular cycle may include a cycle for drying the dishes with heat generated by the washing cycle, a cycle for drying the dishes with purifying hot air introduced through the air supply unit 510, or a second ventilation cycle.

The sensing S311, S312, S313 by the sensors 210, 220, 230 and the judgment and verification S320 by the control unit 240 may be performed in parallel with the process of the control unit 240 controlling the drive unit 300 for partially opening the door 11. If the control unit 240 determines and verifies that the door 11 has not exactly entered the partially open state, the control unit 240 may control the actuator 300 so that the door 11 is exactly in the partially open state based on the determination and verification S320.

The various embodiments of the present disclosure described above may be combined with one or more additional embodiments and may be changed within the range in which they can be understood by those skilled in the art based on the foregoing detailed description. The embodiments of the present disclosure should be understood as illustrative but not restrictive in all respects. For example, each component described as unitary may be implemented in a distributed d manner, and similarly, components described as distributed may also be implemented in a combined form. Therefore, all changes and modifications derived from the meanings and scope of the claims of the present disclosure and their equivalent concepts should be construed as being included in the scope of the present disclosure.

What is claimed is:

1. A door opening device for a dishwasher, the door opening device being provided on one side of a main body of the dishwasher and performing opening of a door with respect to the main body, the door opening device comprising:

a case fixed to the main body;

a movable member disposed inside the case to be slidably movable with respect to the case;

a latch unit including at least one latch rotatably mounted on at least one fixing shaft inside the movable member; and a latch guide member disposed on the movable member to be slidably movable with respect to the movable member;

wherein the latch guide member guides the latch unit so that the at least one latch is rotated as the latch guide member slides, and wherein, in the latch guide member, at least one fixing shaft receiving depression extending in forward and rearward directions is formed at a location corresponding to the at least one fixing shaft, and the at least one fixing shaft is inserted into the at least one fixing shaft receiving depression.

2. A door opening and closing device for a dishwasher, the door opening and closing device being provided on one side of a main body of the dishwasher and performing opening of a door with respect to the main body, the door opening and closing device comprising:

a case fixed to the main body;

a movable member disposed inside the case to be slidably movable in forward and rearward directions with respect to the case;

a latch unit including a left latch rotatably mounted on a fixing shaft on an inner left side of the movable member and a right latch rotatably mounted on a fixing shaft on an inner right side of the movable member; and a latch guide member disposed on the movable member to be slidably movable over a predetermined distance in the forward and rearward directions with respect to the movable member;

wherein the latch guide member guides the latch unit so that the left and right latches are rotated symmetrically with each other as the latch guide member slides, and wherein, in the latch guide member, left and right fixing shaft receiving depressions extending in the forward and rearward directions are formed at locations corresponding to the left and right fixing shafts, respectively, and the left and right fixing shafts are inserted into the left and right fixing shaft receiving depressions, respectively.

3. The door opening and closing device of claim 2, wherein a fastening hole provided between front and rear ends of the left latch is fitted around the left fixing shaft and a fastening hole provided between front and rear ends of the right latch is fitted around the right fixing shaft, so that the left and right latches are rotatably disposed around the respective fixing shafts on the movable member.

4. The door opening and closing device of claim 3, wherein:

the latch guide member is slidable forward and rearward with respect to the movable member between a frontmost location at which the left and right fixing shafts of the movable member come into contact with rear ends of the left and right fixing shaft receiving depressions, respectively, and a rearmost location at which the left and right fixing shafts of the movable member come into contact with front ends of the left and right fixing shaft receiving depressions, respectively.

5. The door opening and closing device of claim 4, wherein:

in the latch guide member, left and right latch guide depressions extending in inclined directions with respect to the forward and rearward directions are formed behind the fixing shaft receiving depressions;

a coupling protrusion formed behind the fastening hole of the left latch is inserted into the left latch guide depression, and a coupling protrusion formed behind the fastening hole of the right latch is inserted into the right latch guide depression; and the left and right latch guide depressions are inclined in directions in which they become closer to an inside of the latch guide member in directions from front ends to rear ends thereof.

6. The door opening and closing device of claim 5, wherein:

when the latch guide member moves forward, the coupling protrusions of the left and right latches are guided by the left and right latch guide depressions and moved toward a center of the latch guide member, so that the left and right latches are rotated in directions in which the rear ends thereof approach each other and the front ends thereof move away from each other; and when the latch guide member moves rearward, the coupling protrusions of the left and right latches are guided by the left and right latch guide depressions and moved toward left and right sides of the latch guide member, so that the left and right latches are rotated in directions in which the rear ends thereof move away from each other and the front ends thereof approach each other.

7. The door opening and closing device of claim 6, wherein:

the rear end of the left latch is coupled to a first elastic element disposed on a left arm portion of the movable member, and the rear end of the right latch is coupled to a second elastic element disposed on a right arm portion of the movable member; and as the first and second elastic elements pull the rear ends of the left and right latches by restoring forces, front ends of the left and right latches maintain a close arrangement state, and a gap between the two front ends of the left and right latches is smaller than a size of a coupling boss of the door.

* * * * *